US007850502B2

(12) United States Patent
Nishimura et al.

(10) Patent No.: US 7,850,502 B2
(45) Date of Patent: Dec. 14, 2010

(54) METHOD OF MANUFACTURING ELECTRON-EMITTING DEVICE AND METHOD OF MANUFACTURING IMAGE DISPLAY APPARATUS

(75) Inventors: Yuu Nishimura, Hadano (JP); Tamaki Kobayashi, Isehara (JP); Yusuke Miyamoto, Atsugi (JP); Takuto Moriguchi, Chigasaki (JP); Eiji Takeuchi, Atsugi (JP); Takahiro Sato, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 12/421,780

(22) Filed: Apr. 10, 2009

(65) Prior Publication Data

US 2010/0159781 A1 Jun. 24, 2010

(30) Foreign Application Priority Data

Dec. 19, 2008 (JP) ..... 2008-324464

(51) Int. Cl.
*H01J 9/00* (2006.01)

(52) U.S. Cl. ..... 445/24

(58) Field of Classification Search ..... 445/23–25; 313/495–497

See application file for complete search history.

(56) References Cited

U.S. PATENT DOCUMENTS 6,225,749 B1 5/2001 Kobayashi et al. ..... 315/169.3
6,633,118 B1 10/2003 Yamamoto et al. ..... 313/495
6,642,649 B1 11/2003 Yamamoto et al. ..... 313/495
6,731,060 B1 5/2004 Yamamoto et al. ..... 313/495
6,802,753 B1 10/2004 Ando et al. ..... 445/6
6,849,999 B1 2/2005 Kobayashi et al. ..... 313/495
7,230,372 B2 6/2007 Yamamoto et al. ..... 313/311
7,264,530 B2 9/2007 Kobayashi et al. ..... 445/35
7,271,529 B2 9/2007 Takeda et al. ..... 313/311
7,312,561 B2 12/2007 Moriguchi et al. ..... 313/310
7,513,814 B2 4/2009 Kobayashi et al. ..... 445/24
7,572,164 B2 8/2009 Takeda et al. ..... 445/46
7,582,002 B2 9/2009 Yamamoto et al. ..... 445/51
7,583,015 B2 9/2009 Nukanobu et al. ..... 313/309
2008/0122336 A1 5/2008 Nukanobu et al. ..... 313/310
2009/0237570 A1 9/2009 Moriguchi et al. ..... 348/725
2009/0244398 A1 10/2009 Nukanobu et al. ..... 348/725

FOREIGN PATENT DOCUMENTS

JP 9-330646 12/1997
JP 2001-167693 6/2001

*Primary Examiner*—Joseph L Williams
(74) *Attorney, Agent, or Firm*—Fitzpatrick, Cella, Harper & Scinto

(57) ABSTRACT

An electron-emitting device manufacturing method includes a first step of forming a conductive film on an insulating layer having an upper surface and a side surface connected to the upper surface via a corner portion so as to extend from the side surface to the upper surface and cover at least a part of the corner portion, and a second step of etching the conductive film in a film thickness direction. At the first step, the conductive film is formed so that film density of the conductive film on the side surface of the insulating layer becomes the same as or higher than film density of the conductive film on the upper portion of the insulating film.

12 Claims, 11 Drawing Sheets

A: INCIDENT DIRECTION
11: SUBSTRATE HORIZONTAL DIRECTION
12: SUBSTRATE NORMAL LINE DIRECTION

METHOD OF MANUFACTURING ELECTRON-EMITTING DEVICE AND METHOD OF MANUFACTURING IMAGE DISPLAY APPARATUS

BACKGROUND OF THE INVENTION

1. Field of the Invention

The present invention relates to a method of manufacturing an electron-emitting device and a method of manufacturing an image display apparatus.

2. Description of the Related Art

Field emission electron-emitting devices are devices which field-emit electrons from the cathode electrode by a voltage applied between a cathode electrode and a gate electrode. Japanese Patent Application Laid-Open (JP-A) No. 2001-167693 discloses an electron-emitting device which is provided a cathode along a side surface of an insulating layer provided onto a substrate and has a recess portion on a part of the insulating layer.

SUMMARY OF THE INVENTION

In the electron-emitting devices disclosed in JP-A No. 2001-167693, a high-potential electrode on a gate side and a low-potential electrode on a cathode side slightly contact or are connected to each other in the recess portion so that an ineffective current is occasionally generated depending on manufacturing methods. Further, in some manufacturing methods, when a lot of electron-emitting devices are formed on one substrate, the cathode side and the gate side are short-circuited in some electron-emitting devices. Therefore, reliability is desired to be further improved. Electron emission efficiency is requested to be further heightened. The electron emission efficiency ($\eta$) is derived according to the efficiency $\eta=Ie/(If+Ie)$ by using an electric current (If) flowing between the cathode electrode and the gate electrode at the time of applying a drive voltage to the electron-emitting device and an electric current (Ie) taken out into a vacuum.

The present invention is devised in order to solve the above problem, and its object is to provide a method of manufacturing an electron-emitting device where generation of an ineffective current and short-circuit is repressed and the reliability and the electron emission efficiency are high.

The present invention devised in order to solve the above problem is an electron-emitting device manufacturing method including: a first step of forming a conductive film on an insulating layer having an upper surface and a side surface connected to the upper surface via a corner portion so as to extend from the side surface to the upper surface and cover at least a part of the corner portion; and a second step of etching the conductive film in a film thickness direction, wherein at the first step, the conductive film is formed so that film density of a portion of the conductive film on the side surface of the insulating layer becomes equivalent to film density of a portion of the conductive film on the upper surface of the insulating layer.

The electron-emitting device with high reliability in which generation of ineffective current (leak current) and short circuit is repressed and short circuit can be provided. Further, the electron-emitting device with high electron emission efficiency can be formed stably.

Further features of the present invention will become apparent from the following description of exemplary embodiments with reference to the attached drawings.

DESCRIPTION OF THE EMBODIMENTS

An embodiment is exemplary described in detail below with reference to the drawings. The scope of the present invention is not limited only to dimensions, materials, shapes and relative arrangements of components described in the embodiment unless otherwise noted.

Firstly an outline of one example of an electron-emitting device which is formed by a manufacturing method described in the embodiment is described. Details of the constitution of the electron-emitting device are described in detail after the manufacturing method in the embodiment is described.

Figure 1A:
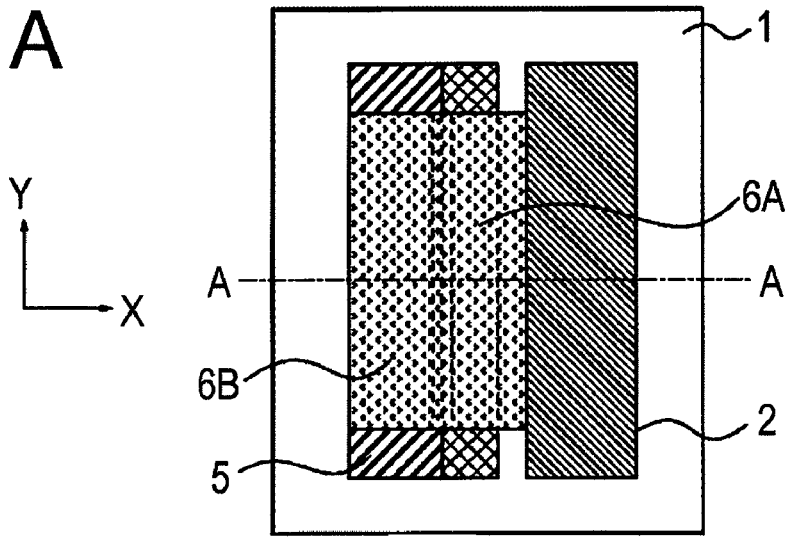
FIGS. 1A to 1C are diagrams illustrating one example of a constitution of an electron-emitting device.
Figure 1B:
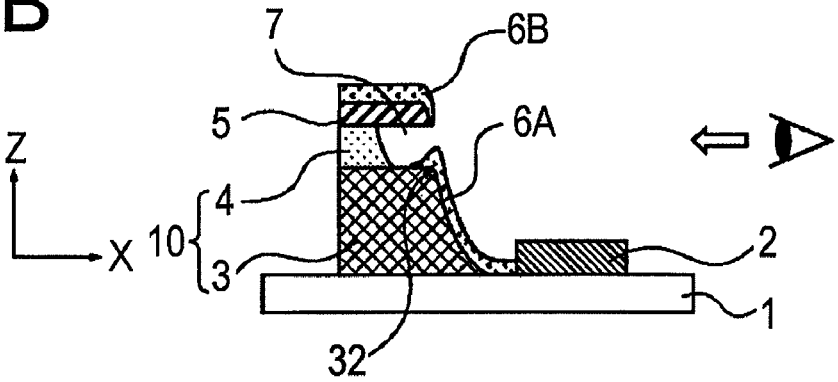
Figure 1C:
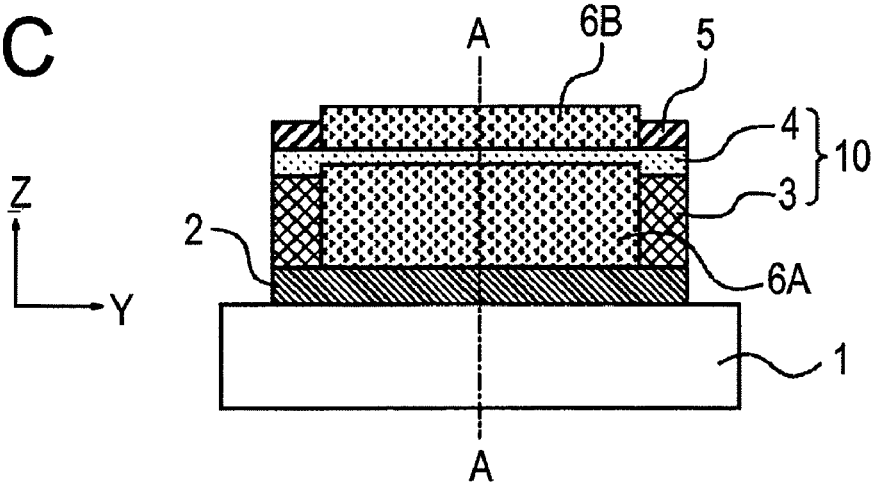
Figure 3B:
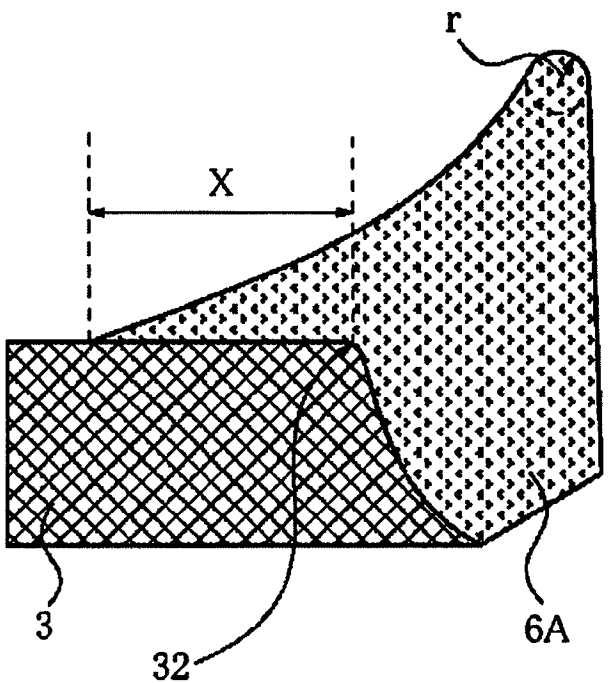
FIGS. 3A and 3B are enlarged side views illustrating a vicinity of an electron-emitting portion of the electron-emitting device.
Figure 3A:
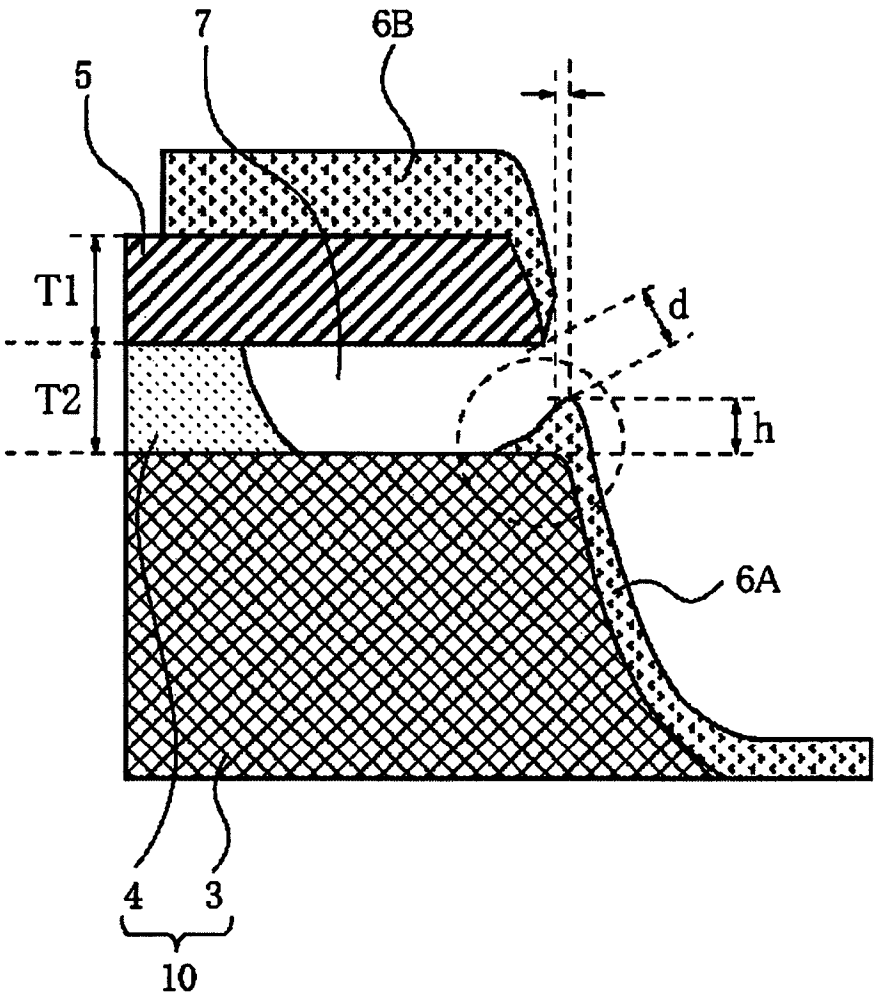

FIG. 1A is a schematic plan diagram of the electron-emitting device, and FIG. 1B is a cross-sectional view taken along A-A line in FIG. 1A (A-A line in FIG. 1C) FIG. 1C is a side view when the electron-emitting device is viewed from a direction of an arrow in FIG. 1B. FIG. 3A is an enlarged diagram of FIG. 1B, and FIG. 3B is an enlarged diagram illustrating an area surrounded by a circular dotted line of FIG. 3A (protruding portion of a conductive film 6A).

An insulating step forming member 10 and a cathode electrode 2 are arranged adjacent to each other on a substrate 1. The step forming member 10 is formed by layering a first insulating layer 3 and a second insulating layer 4. A conductive film 6A is arranged on a slope along the slope which is a side surface of the first insulating layer 3 on the cathode electrode 2 side. The conductive film 6A covers the slope (side surface), an upper surface and a corner portion (edge portion) 32 of the first insulating layer 3. The conductive film 6A extends from the cathode electrode 2 into a recess portion 7 of the step forming member 10. One end portion of the conductive film 6A is connected to the cathode electrode 2, and the other end portion of the conductive film 6A forms a protruding portion across the inside of the recess portion (the upper surface of the insulating layer 3 in the recess portion 7)

and the side surface (or corner portion 32) of the first insulating layer 3. Therefore, it can be said that the protruding portion is provided on the corner portion 32 of the first insulating layer 3 (a portion where the upper surface and the side surface of the first insulating layer 3 are connected). A tip of the protruding portion is far from a surface of the substrate 1 further than the upper surface of the first insulating layer 3, and the tip is pointed. A gate electrode 5 is separated from the first insulating layer by a predetermined distance (the thickness of the second insulating layer) by the second insulating layer 4 provided between the gate electrode 5 and the first insulating layer 3. A conductive film 6B is provided on the gate electrode 5. For this reason, the entire members 5 and 6B can be called as a gate electrode.

An arrangement position of the gate electrode 5 is not limited to a form shown in FIG. 1B. That is to say, the gate electrode 5 may be arranged with a predetermined gap with respect to the conductive film 6A so as to apply an electric field for enabling field emission to the conductive film 6A as the electron-emitting member. In this case, the second insulating layer 4 is not occasionally necessary. The conductive film 6B is provided onto the gate electrode 5 here, but the conductive film 6B can be omitted.

A drive voltage is applied between the cathode electrode 2 and the gate electrode 5 so that a potential of the gate electrode 5 becomes higher than that of the cathode electrode 2. As a result, electrons are field-emitted from the protruding portion of the conductive film 6A. For this reason, the conductive film 6A corresponds to a cathode. Not shown in FIG. 1B, but an anode electrode 20 whose potential is higher than the gate electrode is arranged above the substrate 1 (position separated further than the gate electrode 5) (see FIG. 2).

The corner portion 32 of the first insulating layer 3 is a portion where the upper surface and the side surface of the first insulating layer 3 are connected. The corner portion 32 may be a portion where the upper surface (side surface) is connected to the side surface (upper surface) of the first insulating layer 3. The corner portion 32 may have a form without curvature (namely, a form that an edge of the upper surface and an edge of the side surface collide with each other), or a form with curvature. That is to say, the upper surface and the side surface of the first insulating layer 3 can be connected via the portion having a predetermined curvature radius (corner portion 32). When the corner portion 32 has the curvature, the conductive film 6A can be formed stably, and is advantageous from a viewpoint of the electron emission property of the electron-emitting device.

A method of manufacturing the electron-emitting device having the above constitution according to the embodiment is described below with reference to FIGS. 6A to 6F.

A series of steps in the manufacturing method according to the embodiment is described simply, and thereafter, the respective steps are detailed.

(Step 1)

Figure 6A:
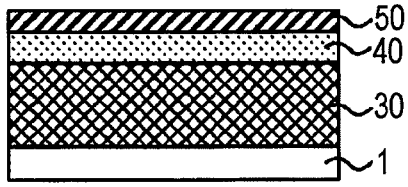
FIGS. 6A to 6F are diagrams explaining steps of a method of manufacturing the electron-emitting device.

An insulating layer 30 to be the first insulating layer 3 is formed on the surface of the substrate 1, and an insulating layer 40 to be the second insulating layer 4 is laminated on the upper surface of the insulating layer 30. A conductive layer 50 to be the gate electrode 5 is laminated on an upper surface of the insulating layer 40 (FIG. 6A). A material of the insulating layer 40 is selected differently from a material of the insulating layer 30 so that an amount of etching using an etching liquid (etchant) used at step 3, described later, on the insulating layer 40 becomes larger than that of the insulating layer 30.

(Step 2)

An etching process for the conductive layer 50, the insulating layer 40 and the insulating layer 30 (first etching process) is executed.

Specifically, the first etching process is a process for etching the conductive layer 50, the insulating layer 40 and the insulating layer 30 after forming a resist pattern on the conductive layer 50 by using a photolithography technique. At step 2, the first insulating layer 3 and the gate electrode 5 composing the electron-emitting device shown in FIG. 1B are formed basically (FIG. 6B). As shown in FIG. 6B, it is preferable that an angle ($\alpha$) formed by the side surface (slope) 22 of the first insulating layer 3 formed at this step and the surface of the substrate 1 becomes smaller than 90°. Further, it is preferable that an angle ($\Phi$) formed by the side surface (slope) 52 of the gate electrode 5 and the upper surface of the first insulating layer 3 (surface of the substrate 1) becomes smaller than the angle ($\alpha$) formed by side surface (slope) of the first insulating layer 3 and the surface of the substrate 1.

(Step 3)

Figure 6D:
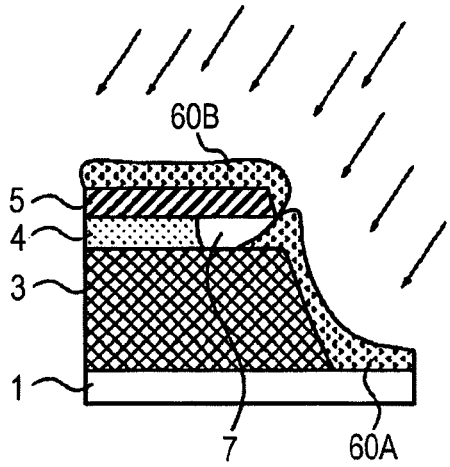
Figure 6B:
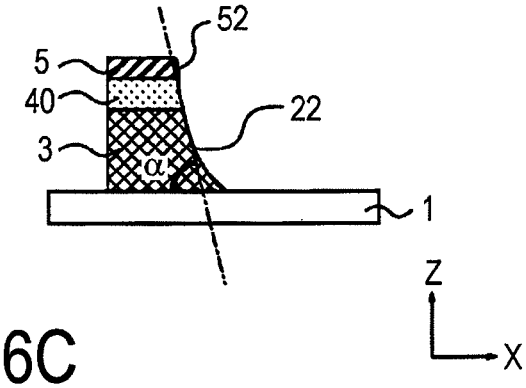
Figure 6E:
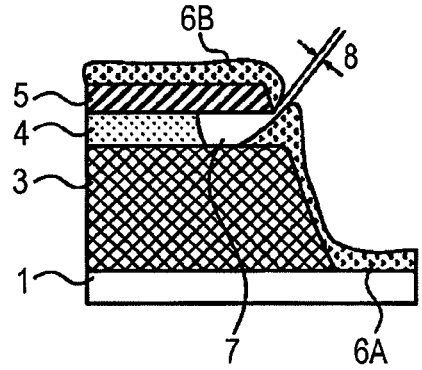
Figure 6C:
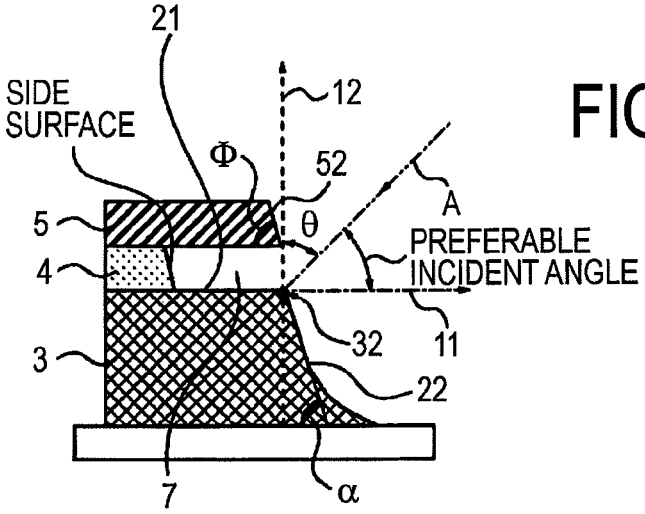

An etching process (second etching process) for the insulating layer 40 is executed (FIG. 6C).

At step 3, the second insulating layer 4 forming the electron-emitting device shown in FIG. 1B is formed basically. As a result, the recess portion 7 composed of a part of the upper surface 21 of the first insulating layer 3 and the side surface of the second insulating layer 4 is formed (FIG. 6C). More specifically, the recess portion 7 is formed by a part of the lower surface of the gate electrode 5, a part of the upper surface of the first insulating layer 3 and the side surface of the second insulating layer 4. At step 3, since the side surface of the insulating layer 40 is etched, a part of the upper surface 21 of the first insulating layer 3 is exposed. A portion where the exposed upper surface 21 of the first insulating layer 3 and the slope 22 to be the side surface of the first insulating layer 3 are connected is the corner portion 32.

(Step 4)

A film 60A made of a material composing the conductive film (6A) is deposited so as to cover from the surface of the substrate 1, via the slope 22 to be the side surface of the first insulating layer 3 on the cathode electrode 2 side, to the upper surface 21 of the first insulating layer 3.

That is to say, the conductive film 60A covers at least a part of the corner portion 32 of the first insulating layer 3, and extends from the slope (side surface) 22 of the first insulating layer 3 through the upper surface 21 of the first insulating layer 3.

The conductive film 60A is deposited so that its film densities are equivalent on a portion on the upper surface 21 of the first insulating layer 3 and a portion on the slope 22 of the first insulating layer 3. Preferably, the conductive film 60A is deposited so that the film density of the portion on the slope 22 of the first insulating layer 3 is equivalent or more to the film density of the portion on the upper surface 21 of the first insulating layer 3. At the same time, the film 60B made of the material composing the conductive film (6B) can be deposited on the gate electrode 5. In such a manner, the conductive film 60A (and 60B) is formed (FIG. 6D).

In an example shown in FIG. 6D, the conductive film 60A and the conductive film 60B are deposited so as to contact with each other. At step 4, the conductive films 60A and 60B can be deposited so as not to contact with each other, namely, so that a gap is formed.

Details are described later, but it is desirable that the conductive films 60A and 60B are deposited so as to contact with each other as shown in FIG. 6D in order to control a size of the gap (distance d in FIG. 3A) accurately.

(Step 5)

An etching process (third etching process) for the conductive films (60A and 60B) is executed (FIG. 6E).

As the main aim of the third etching process, the conductive films (60A and 60B) are etched in a film thickness direction.

In the case that the conductive films 60A and 60B contact with each other at step 4, a gap 8 is formed therebetween at step 5. Unnecessary conductive materials (materials composing the conductive films (60A and 60B)) which are attached into the recess portion can be removed. As a result, the conductive films 6A and 6B are formed.

At step 5, in some cases, an oxidizing process for oxidizing the surfaces of the conductive films (60A and 60B) is added before the third etching process. Step 5 is occasionally a step at which the oxidizing process and the etching process are repeated.

Executing the oxidizing process and the etching process can improve controllability of the etching of the conductive film 6A in comparison with the case where the etching process is simply executed. Further, the gap 8 can be formed between the conductive films 6A and 6B with good controllability.

At step 5, the curvature radius of the tip of the protruding portion as the end portion of the conductive film 6A opposed to the conductive film 6B can be reduced. As a result, the electron-emitting device with higher electron emission efficiency can be formed stably.

Step 5 is a process for etching the conductive films (60A and 60B) in the film thickness direction. At step 5, entire exposed surfaces of the conductive films (60A and 60B) are exposed to the etchant.

(Step 6)

Figure 6F:
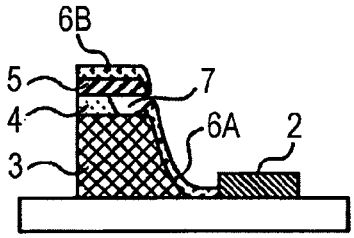

The cathode electrode 2 for supplying electrons to the conductive film 6A is formed (FIG. 6F). This step can be moved to before or after the other steps. The cathode electrode 2 is not used, and the conductive film (cathode) 6A can fulfill the function of the cathode electrode 2. In this case, step 6 is omitted.

Basically, at steps 1 through 6, the electron-emitting device shown in FIGS. 1A and 3A can be formed.

The respective steps can be described in more detail below.

(About Step 1)

The substrate 1 is a substrate which supports the electron-emitting device. As the substrate 1, quartz glass, glass where a contained amount of impurity such as Na is reduced, or soda-lime glass can be used. The functions necessary for the substrate 1 include not only high mechanical strength but also resistance properties against dry etching, wet etching, and alkali and acid of a developer or the like. When the substrate 1 is used for an image display apparatus, since it undergoes a heating step, the substrate 1 desirably has coefficient of thermal expansion is less different from that of a member to be laminated. In view of the thermal treatment, a material in which an alkaline element difficulty diffuses from the inside of the glass into the electron-emitting device is desirable.

The insulating layer 30 (first insulating layer 3) is made of a material with excellent workability, and its example includes silicon nitride (typically $Si_3N_4$) and silicon oxide (typically $SiO_2$). The insulating layer 30 can be formed by a general vacuum deposition method such as a sputtering method, a CVD (chemical vapor deposition) method, or a vacuum evaporation method. A thickness of the insulating layer 30 is set within a range of a several nm to several dozen μm, and preferably within a range of several dozen nm to several hundred nm.

The insulating layer 40 (second insulating layer 4) is made of a material with excellent workability, and this example includes silicon nitride (typically $Si_3N_4$) and silicon oxide (typically $SiO_2$). The insulating layer 40 can be formed by the general vacuum deposition method such as the sputtering method, the CVD method, or the vacuum evaporation method. A thickness of the insulating layer 40 is thinner than the insulating layer 30, and is set within a range of a several nm to several hundred nm, and preferably a several nm to several dozen nm.

After the insulating layers 30 and 40 are laminated on the substrate 1, the recess portion 7 should be formed at step 3. For this reason, in the second etching process, an etching amount on the insulating layer 40 is larger than that on the insulating layer 30. Desirably a ratio of the etching amount between the insulating layers 30 and 40 is 10 or more, and more preferably 50 or more.

In order to obtain such a ratio of the etching amount, the insulating layer 30 may be formed by a silicon nitride film, and the insulating layer 40 may be composed of a silicon oxide film, PSG whose phosphorus density is high or a BSG film whose boron density is high. PSG is phosphorus silicate glass, and BSG is boron silicate glass.

The conductive layer 50 (gate electrode 5) has conductivity, and is formed by the general vacuum deposition technique such as the evaporation method and the sputtering method.

A material of the conductive layer 50 to be the gate electrode 5 desirably has conductivity, high thermal conductivity, and high melt point. Metal such as Be, Mg, Ti, Zr, Hf, V, Nb, Ta, Mo, W, Al, Cu, Ni, Cr, Au, Pt or Pd, or a metal alloy material thereof can be used. Further, carbide, boride or nitride can be used, or semiconductor such as Si or Ge can be also used.

A thickness of the conductive layer 50 (gate electrode 5) is set within a range of a several nm to several hundred nm, and preferably within a range of several dozen nm to several hundred nm.

Since a film thickness of the conductive layer 50 to be the gate electrode 5 is occasionally set to be thinner than the cathode electrode 2, the conductive layer 50 is desirably made of a material with lower resistance than that of the cathode electrode 2.

(About Step 2)

The first etching process preferably uses RIE (Reactive Ion Etching) in which etching gas is converted into plasma and is emitted to the material, so that the material can be etched precisely.

When a member to be processed is made of a material for forming fluoride, fluorine gas such as $CF_4$, $CHF_3$ or $SF_6$ is selected as the gas used for RIE. When the member to be processed is made of a material forming chloride such as Si or Al, chlorine gas such as $Cl_2$ or $BCl_3$ is selected. In order to obtain a selected ratio with respect to resist and in order to secure smoothness on an etching surface or heighten an etching speed, at least any one of hydrogen, oxygen and argon gas is added to etching gas.

At step 2, the shapes which are the same as or the approximately same as the first insulating layer 3 and the gate electrode 5 composing the electron-emitting device shown in FIG. 1A are formed basically. However, it does not mean that the first insulating layer 3 and the gate electrode layer 5 are not etched entirely at the etching process after step 2.

Further, the angle formed by the side surface (slope) 22 of the first insulating layer 3 and the surface of the substrate 1 (shown by α in FIG. 6B) can be controlled to a desired value by controlling conditions such as types of gas and pressure.

Angle α is preferably smaller than 90°. This is because the film quality (film density) of the conductive film 60A (conductive film 6A) formed on the slope 22 of the first insulating layer 3 at step 4 is controlled.

When α is set to be smaller than 90°, the side surface 52 of the gate electrode 5 on the cathode electrode side retreats with respect to the side surface 22 of the first insulating layer 3 on the cathode electrode side. The angle (Φ) formed by the side surface (slope) 52 of the gate electrode 5 and the upper surface of the first insulating layer 3 (the surface of the substrate 1) is preferably set to be smaller than the angle (α) formed by the side surface (slope) 22 of the first insulating layer 3 and the surface of the substrate 1. That is to say, an angle (90°−Φ) formed by the side surface 52 of the gate electrode 5 and a normal line 12 of the upper surface 21 of the first insulating layer 3 (the surface of the substrate 1) is preferably set to be larger than an angle (90°−α) formed by the side surface 22 of the first insulating layer 3 and the normal line 12 of the upper surface 21 of the first insulating layer 3 (the surface of the substrate 1).

When a tangent line to the side surface 22 of the first insulating layer 3 is drawn from the corner portion 32 (see FIG. 6C) towards the substrate 1, angle α can be expressed by an angle formed by the tangent line and the substrate 1.

(About Step 3)

At step 3, an etching liquid is selected so that an amount of etching the insulating layer 3 using the etching liquid is sufficiently smaller than an amount of etching the insulating layer 40 using the etching liquid.

At the second etching process, when the insulating layer 40 is formed by silicon oxide and the first insulating layer 3 (insulating layer 30) is formed by silicon nitride, so-called buffered hydrogen fluoride (BHF) may be used as the etching liquid. The buffered hydrogen fluoride (BHF) is a mixed solution of ammonium fluoride and hydrofluoric acid. Further, when the insulating layer 40 is formed by silicon nitride and the first insulating layer 3 (insulating layer 30) is formed by silicon oxide, hot phosphoric acid etching liquid may be used as etchant.

At step 3, the pattern which is the same as or the approximately same as the second insulating layer 4 composing the electron-emitting device shown in FIG. 1A is formed. However, it does not mean that the second insulating layer 4 is not entirely etched at the etching process after step 3.

A depth of the recess portion 7 (distance in a widthwise direction) deeply relates to a leak current of the electron-emitting device. As the recess portion 7 is made to be deeper, the value of the leak current becomes smaller. However, when the recess portion 7 is too deep, a problem such that the gate electrode 5 is deformed arises. For this reason, the depth is practically set to not less than 30 nm and not more than 200 nm. The depth of the recess portion 7 can be put into a distance from the side surface 22 of the first insulating layer 3 (or the corner portion 32) to the side surface of the insulating layer 4.

(About Step 4)

At step 4, the conductive films (60A and 60B) are formed by the vacuum deposition technique such as the evaporation method and the sputtering method.

The conductive film 60A is deposited so that its film quality (film density) of a portion located on the upper surface 21 of the first insulating layer 3 is equivalent to the film quality of a portion located on the side surface (slope) 22 of the first insulating layer 3.

This is because the following state in the third etching process at step 5 is repressed. A portion of the conductive film 60A deposited on the side surface of the first insulating layer is etched more quickly than a portion deposited on the upper surface 21 of the first insulating layer 3.

As a result of examination by the inventors of this application, it is found that when the film density varies between the portion of the conductive film 60A deposited on the side surface 22 of the first insulating layer and the portion of the conductive film 60A deposited on the upper surface 21 of the first insulating layer 3, the etching speeds are different from each other. When the portion deposited on the side surface (slope) of the first insulating layer is etched more quickly at the third etching process, supply of potential to the protruding portion of the conductive film 6A to be the electron-emitting portion (see FIG. 1B) becomes unstable or insufficient.

At step 4, therefore, the conductive film 60A is preferably deposited by a film forming method (film deposition method) having directional characteristic (directionality). For example, a so-called directional sputtering method or an evaporation method can be used. When the deposition method having directionality is used, an angle at which the material of the conductive films (60A and 60B) enters the upper surface and the side surface of the first insulating layer 3 (and the upper surface and the side surface of the gate electrode 5) can be controlled.

Figure 5A:
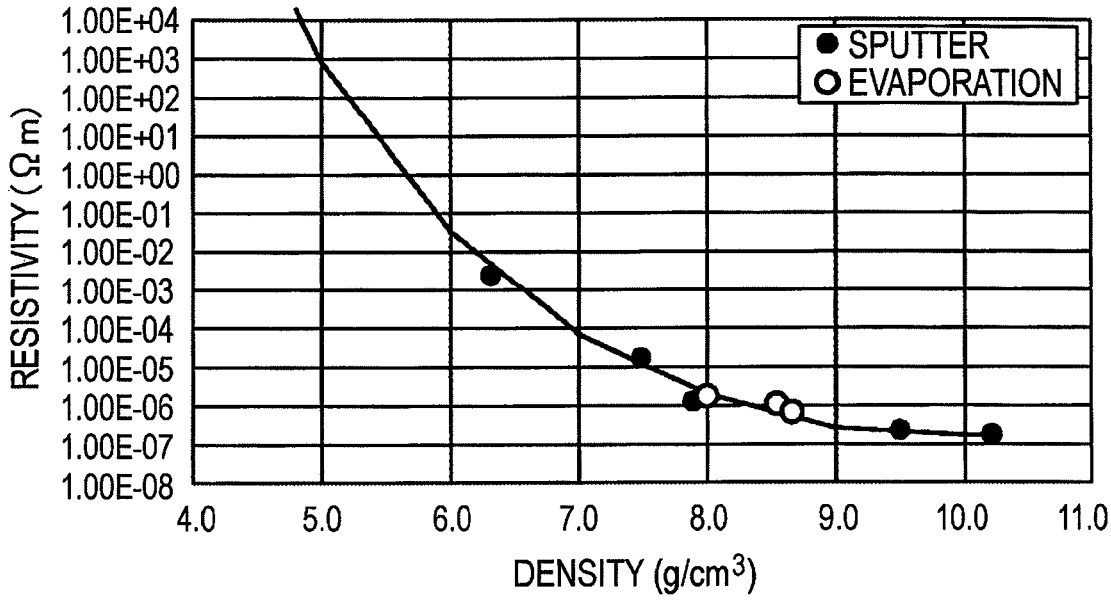
FIG. 5A is a diagram illustrating a relationship between metal film density and resistivity.
Figure 5B:
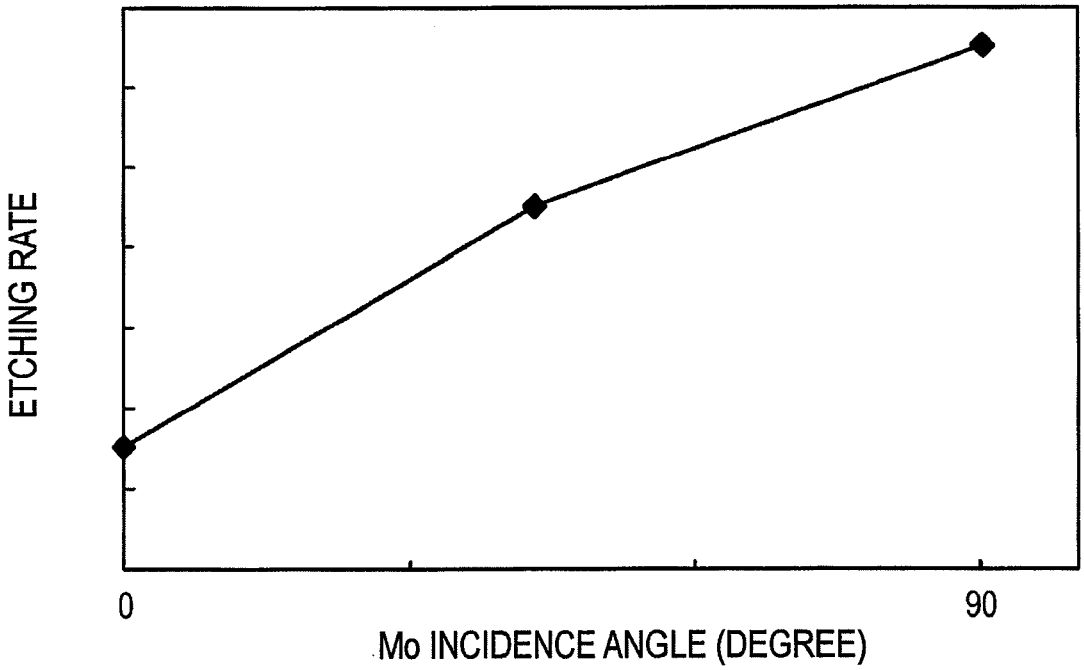
FIG. 5B is a diagram illustrating a relationship between a deposition angle and an etching rate.

FIG. 5B illustrates that the etching rate at the third etching process at step 5 depends on an incident direction of sputtered particles with respect to a deposition surface. In FIG. 5B, an abscissa axis is the angle (incidence angle) formed by the normal line direction of the surface (deposition surface) where the film is deposited and the incident direction of the deposition material, and an ordinate axis is the etching rate. As the angle formed by the normal line direction of the surface where the film is deposited (deposition surface) and the incident direction of the deposition material reduces, the etching rate reduces. On the other hand, as the angle formed by the normal line direction of the deposition surface and the incident direction of the sputtered particles is closer to 90°, the etching rate increases.

Specifically, in the directional sputtering, after the angle between the substrate 1 and a target is set, a shielding plate is provided between the substrate 1 and the target, or a distance between the substrate 1 and the target is set to around a mean free path of the sputtered particles. A so-called collimation sputtering method using a collimator for giving directionality to the sputtered particles is also included in the directional sputtering method. Only the sputtered particles at the limited angle (atoms or particles sputtered from the sputtering target) can enter the surface to be deposited (the slope of the insulating layer 30 or the like).

That is to say, the incidence angle of the sputtered particles with respect to the side surface 22 of the first insulating layer 3 is set to be equivalent to the incidence angle of the sputtered particles with respect to the upper surface 21 of the first insulating layer 3. As a result, the sputtered particles (deposition material) enter both the side surface 22 of the first insulating layer 3 and the upper surface 21 of the first insulating layer 3 at the equivalent angle. With such deposition, the end portion of the conductive film 60A on the upper surface 21 (corner portion 32) of the first insulating layer 3 can be provided with a protruding shape (protruding portion). As a result, the protruding portion can be pointed by the third etching process at step 5.

In the evaporation method, when a film is deposited under high vacuum of about $10^{-2}$ to $10^{-4}$ Pa, a vaporized material (deposition material) evaporated from an evaporation source less likely collides. Further, since the mean free path of the vaporized material (deposition material) is about several hundred mm to a several m, the vaporized material reaches the substrate with maintaining directionality at the time of evaporating from the evaporation source. For this reason, the evaporation method is a deposition method having directionality. The method of evaporating the evaporation source includes resistance heating, high-frequency induction heating and electron beam heating. The method using electron beams is effective from viewpoints of types of suitable materials and a heating area.

By using the deposition method having directionality, there exists a condition such that the film quality of the conductive film 60A on the side surface 22 of the first insulating layer 3 is equivalent to the film quality on the upper surface 21 of the first insulating layer 3 (or on the corner portion 32). As a result, there is a condition such that the etching rate of the portion of the conductive film 60A on the side surface 22 of the first insulating layer 3 is equivalent to the etching rate of the portion on the upper surface 21 of the first insulating layer 3 (or on the corner portion 32).

The condition of the incident direction A of the deposition material such that the etching rates of the conductive film deposited on the side surface 22 and the upper surface 21 of the first insulating film 3 are equivalent to each other is described below.

The relationship that $\theta=\alpha/2$ should be satisfied, where $\alpha$ is the angle formed by the side surface 22 of the first insulating layer 3 and the horizontal direction 11 of the substrate 1, and $\theta$ is the angle formed by the incident direction A of the deposition material and the normal direction 12 of the substrate 1. In this case, the film quality of the conductive film deposited on the side surface 22 of the first insulating layer 3 can be equivalent to the film quality of the conductive film deposited on the upper surface 21 of the insulating layer 3. The angle $\alpha$ has a value larger than 0° and smaller than 90°. In order to separate the electron-emitting portion from the surface of the substrate 1 and concentrate the electric field on the protruding portion, the angle $\alpha$ is desirably set to a value larger than 45° practically.

Since the insulating layer 3 is formed on the surface of the substrate 1 by the deposition method to be generally used, the upper surface 21 of the insulating layer 3 is parallel (or substantially parallel) with the surface of the substrate 1 (horizontal direction 12). That is to say, the upper surface 21 of the insulating layer 3 is occasionally parallel with the surface of the substrate 1 completely, but the upper surface 21 normally has a slight tilt according to deposition environment and condition. Also in this case, the upper surface 21 is parallel or substantially parallel with the surface of the substrate 1. However, the present invention can be applied also to a case where the upper surface 21 of the insulating layer 3 is intentionally non-parallel with the surface of the substrate 1 (horizontal direction 12). That is to say, an incidence angle of a material (sputtered particles) of the conductive film with respect to the side surface 22 of the first insulating layer 3 may be set to be equivalent to an incidence angle of the material of the conductive film with respect to the upper surface 21 of the first insulating layer 3.

As described above, the deposition material of the conductive film enter from a direction where the angle formed by the upper surface 21 of the insulating layer 3 and the side surface 22 of the insulating layer 3 is bisected, and thereby the film quality of the portion of the conductive film 60A on the upper surface 21 of the insulating layer 3 can be equivalent to the film quality of the portion on the side surface 22 of the insulating layer 3.

In the directional sputtering method, a direction where sputtered particles fly from a target (incident direction of the sputtered particles) may be set on a bisector of the angle formed by the upper surface 21 of the insulating layer 3 and the side surface 22 of the insulating layer 3.

The film quality of the portion of the conductive film 60A on the side surface 22 of the insulating layer 3 can be equivalent or more to the film quality of the portion of the conductive film 60A on the upper surface 21 of the insulating layer 3. In this case, the angle $\theta$ is set to not less than $\alpha/2$ and not more than 90° ($\alpha/2 \leqq \theta 90°$) (see FIG. 6C). That is to say, the angle formed by the incident direction A of the material (sputtered particles) of the conductive film and the side surface 22 of the insulating layer 3 may be set to be the same as or larger than the angle formed by the incident direction A of the material of the conductive film and the upper surface 21 of the insulating layer 3. In other words, the incidence angle with respect to the side surface 22 of the insulating layer 3 (the angle formed by the incident direction A and the normal line of the side surface 22 of the insulating layer 3) may be set to be the same as or smaller than the incidence angle with respect to the upper surface 21 of the insulating layer 3 (the angle formed by the incident direction A and the normal line of the upper surface 21 of the insulating layer 3). When $\theta$ exceeds 90°, the conductive film 6A cannot be substantially deposited in the recess portion 7 (on the upper surface 21 of the insulating layer 3). For this reason, 90° is an upper limit. As a result, in the third etching process, preferential removal of the portion on the side surface 22 of the insulating layer 3 can be further repressed.

When $\alpha$ is set to be smaller than 90° at step 2, the side surface of the gate electrode 5 on the cathode electrode 2 side retreats with respect to the side surface of the first insulating layer 3 on the cathode electrode 2 side as described above. As a result, the deposition having directionality at step 4 is carried out, so that the film with good quality which is equivalent or more to the film quality of the portion on the side surface 22 and the upper surface 21 is formed on the corner portion 32. The "film with good quality" can be a "film with high density" or a "film with high film density".

At step 4, the conductive film 60A and the conductive film 60B can be deposited so that the conductive films 60A and 60B do not contact with each other, namely, a gap is formed therebetween.

In the electron-emitting device, as shown in FIG. 3A, the gap as the distance d should be formed precisely between the conductive films 6A and 6B. Particularly when a plurality of electron-emitting devices is formed uniformly, it is important that dispersion of the size of the gaps in the electron-emitting devices is reduced. In order to precisely control the size (distance d) of the gap, the conductive films 60A and 60B are desirably deposited so as to contact with each other at step 4. In other words, the conductive film 60A and the gate electrode 5 are desirably deposited so as to be connected via the conductive film 60B at step 4. Thereafter, the third etching process is executed at step 5 so that the gap is desirably formed between the conductive films 60A and 60B.

When the gap 8 is formed by controlling deposition time and deposition condition at step 4, a portion where the conductive films 60A ad 60B contact at a very small area (leak source) is likely formed in any place of the recess portion 7. For this reason, after step 4, the third etching process at step 5 should be executed.

The conductive films 60A and 60B may be made of the same material or different materials. However, the conductive films 60A and 60B are preferably deposited by the same material simultaneously from viewpoints of easiness of the manufacturing and the controllability of etching.

The material of the conductive films (60A and 60B) may be a conductive and field emission material, and preferably a material with high melt point of 2000° C. or more is selected.

The material of the conductive film 60A is a material with low work function of 5 eV or less, and preferably a material of which oxide can be easily etched. Examples of the material include metal such as Hf, V, Nb, Ta, Mo, W, Au, Pt or Pd, metal alloy, carbide, boride and nitride thereof. At step 5, a process for etching a surface oxide film using a difference in an etching property between the metal and the metal oxide is occasionally executed, Mo or W is preferably used as the material of the conductive films (60A and 60B).

(About Step 5)

As the third etching process, any one of dry etching and wet etching may be used, but the wet etching is preferable in view of ease of controlling an etching selection ratio with respect to another material.

Since the etching amount (or the gap size d) is as very small as about a several nm, the etching rate is desirably 1 or less nm per 1 minute from a viewpoint of stability. The etching rate means a film thickness variation per unit time. A number of atoms removed by the etching process per unit time is determined by the material of the conductive films (60A and 60B) and the etching liquid uniquely. For this reason, the film density is inversely proportional to the etching rate. That is to say, as the film density is higher, the etching rate becomes lower.

The formation of the gap by means of the third etching process is described with reference to FIGS. 7A, 7B and 7C.

Figure 7A:
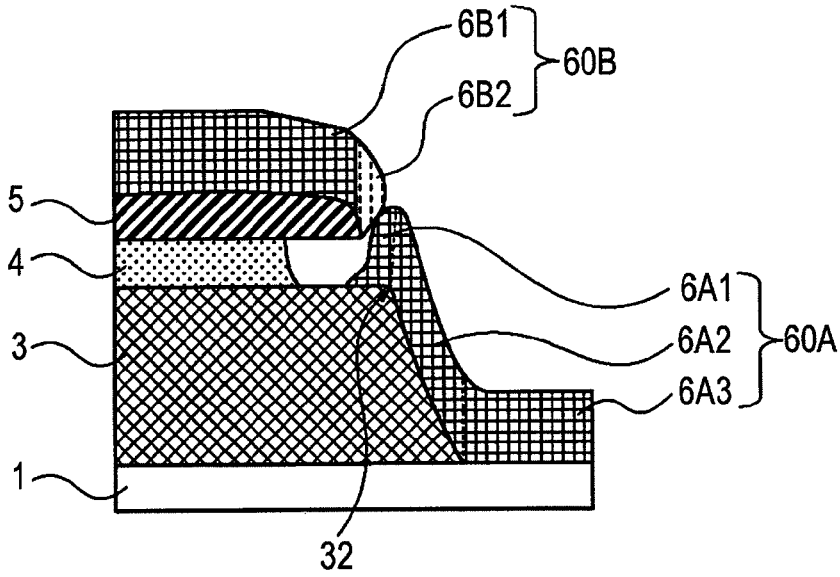
FIGS. 7A to 7C are explanatory diagrams of a third etching process.

FIG. 7A schematically illustrates a difference in the film quality in the state where the conductive films (60A and 60B) are deposited by the deposition method having directionality at step 4. FIGS. 7B and 7C illustrate a state that the third etching process is executed.

Figure 7B:
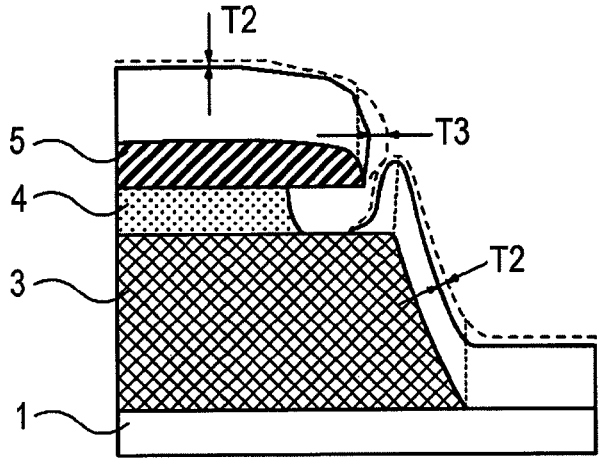

In FIG. 7B, T2 shows a reduction amount of the film thickness of the portion of a high-density film in the third etching process, and T3 shows a reduction amount of the film thickness of the portion of a low-density film in the third etching process. In this embodiment, a relationship such that T2<T3 holds. The reduction amount of the film thickness in the third etching process can be adjusted by the etching time or the number of etching.

The conductive film 60A is deposited at step 4 so that the film quality (film density) of the portion of the conductive film 60A on the upper surface 21 of the first insulating layer 3 becomes equivalent to the film quality of the portion on the side surface 22 of the first insulating layer 3. For this reason, respective portions (6A1, 6A2 and 6A3) have the equivalent film quality. As a result, the etching rates of the respective portions 6A1, 6A2 and 6A3 can be equivalent to each other in the third etching at step 5. The film quality of the portion of the conductive film 60A on the side surface 22 of the insulating layer 3 is occasionally equivalent to or more than the film quality of the portion of the conductive film 60A on the upper surface 21 of the insulating layer 3. In this case, the etching rate of the portion 6A2 is equivalent to or less than the etching rate of the portions 6A1 and 6A3. For this reason, at the third etching step, preferential removal of the portion of the conductive film 60A on the side surface 22 of the first insulating layer 3 can be further repressed.

At step 5, the entire exposed surface of the conductive film is exposed to the etchant (is etched).

At this time, it is preferable that the film quality of the portions 6A1, 6A2, 6A3 and 6B1 is better than the film quality of the portion (6B2) on the side surface 52 of the gate electrode 5 (the etching rate of 6B2 is heightened). As a result, an amount of retreating (etching amount) of the portion of the conductive film 6B on the side surface 52 of the gate electrode 5 can be increased, and thus efficiency of the electron emission can be heightened. In this case, the angle (90°−Φ) formed by the side surface 52 of the gate electrode 5 and the normal line of the substrate 1 may be larger than the angle (90°−α) formed by the side surface 22 of the first insulating layer 3 and the normal line 12 of the substrate 1. As a result, the material of the conductive film 60A (for example, the sputtered particles) enters the side surface 52 of the gate electrode 5 at an angle smaller than the incidence angle with respect to the side surface 22 of the first insulating layer 3. For this reason, a low-density film (or "the film with low film density") is formed on the side surface 52 of the gate electrode 5. Specifically, the angle θ falls within the range ($\alpha/2 \leqq \theta \leqq 90°$) so that the film quality of the portion on the side surface 22 of the insulating layer 3 can be equivalent or more to the film quality of the portion on the upper surface 21 of the insulating layer 3. Further, the following relational expression 1 or 2 may hold.

$$(\alpha+\Phi)/2 \leqq \theta \leqq 90° \quad \text{(Relational expression 1)}$$

$$\alpha/2 \leqq \theta < (\alpha+\Phi)/2 \quad \text{(Relational expression 2)}$$

In the above relational expression 1, a relationship such that $0<\Phi<\alpha$ should hold. In the relational expression 2, a relationship such that $\alpha<\Phi \leqq 90°$ should hold.

At the time of the third etching at step 5, the etching rate of the portion (6B2) of the conductive film 6B on the side surface 52 of the gate electrode 5 is higher than the etching rate of the conductive film 6A.

In the case where $\Phi=\alpha$, even when θ has any value, the film quality on the side surface 22 of the insulating layer 3 always becomes equivalent to the film quality on the side surface 52 of the gate electrode 5. This case is not preferable.

When the portion (6B2) on the side surface 52 of the gate electrode 5 retreats more, probability that the electrons emitted from the tip of the protruding portion of the conductive film 6A as the electron-emitting portion collide with and disperse into the gate electrode 5 can be reduced. As a result, more electrons can reach the anode electrode, and the efficiency of the electron emission can be heightened.

In general XRR (X-ray reflectometry) is used for measurement of the film density, but the measurement occasionally becomes difficult in the actual electron-emitting device. In this case, the following method can be adopted as the film density measuring method. For example, a standard curve is obtained by quantitatively analyzing elements of the film using a high-resolution electron energy loss spectroscopy TEM in which TEM (transmission electron microscope) and EELS (electron energy-loss spectroscope) and comparing the result with that of a known film. The density can be calculated using the standard curve.

A combination of the material of the conductive films (60A and 60B) and the etchant to be used for the third etching process in the present invention is not particularly limited. When the material of the conductive films (60A and 60B) is molybdenum, an alkaline solution such as TMAH (tetramethylammonium hydroxide) and ammonia water can be used as the etchant. A blended material of 2-(2-n-butoxyethoxy) ethanol and alkanolamine or DMSO (dimethylsulfoxide) can be used as the etchant.

When the material of the conductive films (60A and 60B) is tungsten, nitric acid, fluorinated acid, and sodium hydroxide solution can be used as the etchant.

Step 5 is composed of the oxidizing step of oxidizing the surfaces of the conductive films (60A and 60B) and the etching process for etching the surfaces of the oxidized conductive films (60A and 60B).

After an oxide film of a desired amount is formed on the surfaces of the conductive films (60A and 60B) at the oxidizing step, the oxide film is etched to be removed. As a result, an effect which heightens uniformity (reproducibility) of the etching amount can be expected.

The oxidizing amount (oxide film thickness) is inversely proportional to the film density. That is to say, the oxidizing amount (oxide film thickness) of the surface of the portion whose film density is high becomes smaller than the oxidizing amount (oxide film thickness) of the surface of the portion whose film density is low. For this reason, when the conductive films (60A and 60B) are oxidized, the surface layer on the portion whose film density is low (portion 6B2 in FIG. 7A) is oxidized preferentially (selectively). On the other hand, the film quality of the portion of the conductive film 60A on the side surface 22 of the insulating layer 3 is equivalent or more to the film quality of the portion of the conductive film 60A on the upper surface 21 of the insulating layer 3. For this reason, the oxidizing amount of the portion of the conductive film 60A on the side surface 22 of the insulating layer 3 can be equivalent to or smaller than that of the other portions. As a result, the preferential removal of the portion of the conductive film 60A on the side surface 22 of the insulating layer 3 is repressed, and simultaneously, the etching amount of the conductive film and the control accuracy of a distance of the gap can be heightened.

The oxidizing method is not particularly limited as long as the surface of the conductive film 60A can be oxidized by a several to several dozen nm. Specifically, the oxidizing method includes ozone oxidation (excimer UV exposure, low-pressure mercury exposure and corona discharge treatment) or thermal oxidation, but preferably the excimer UV exposure where quantitative property of oxidation is excellent is used. When the material of the conductive film 60A is molybdenum, $MoO_3$ in which the oxide film can be removed easily is mainly created by excimer UV exposure.

Any one of dry and wet etching processes may be used at the step of removing the oxide film, but the wet etching process is used preferably. The step of removing the oxide film (etching step) is for removing (etching) only the oxide film as the surface layer. For this reason, etchant which removes only the oxide film and does not substantially influence a metal layer (non-oxidized layer) as the lower layer is desired. Or it is desired that the etching rate of the oxide film is sufficiently larger (different order of magnitude) than that of the metal film (non-oxidized layer) Specifically, when the material of the conductive film 60A is molybdenum, examples of the etchant are diluted TMAH (density is desirably 0.238% or less) and warm water (desirably 40° C. or more). When the material of the conductive film 60A is tungsten, buffered hydrogen fluoride, diluted hydrochloric acid and warm water can be used.

Figure 7C:
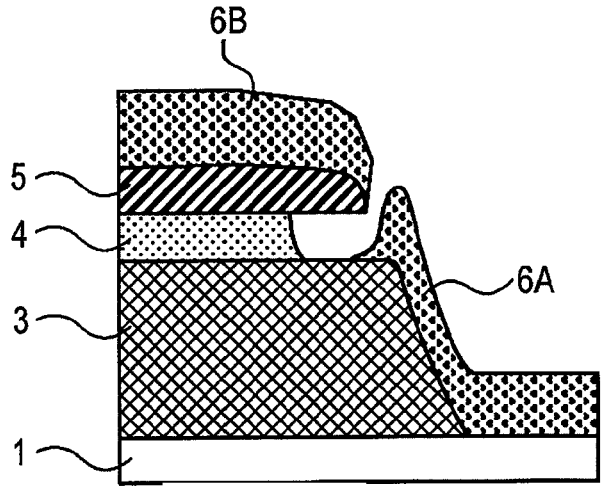

At step 5, the conductive films 6A and 6B are formed (FIG. 7C). The conductive film 6B is provided onto the gate electrode 5 (specifically, on the side surface (slope) and upper surface of the gate electrode). For this reason, the conductive film 6B (the portion on the side surface of the gate electrode 5) can be a portion with which the electrons emitted from the tip of the protruding portion (electron-emitting portion) of the conductive film 6A firstly collide. For this reason, even when a melt point of the material composing the gate electrode 5 is low, the conductive film 6B formed by a material with high melt point can repress deterioration in the electron emission characteristic of the electron-emitting device.

(About Step 6)

The cathode electrode 2 has conductivity similarly to the gate electrode 5, and can be formed by the general vacuum deposition technique such as the evaporation method and the sputtering method, and the photolithography technique. The material of the cathode electrode 2 may be the same as or different from that of the gate electrode 5.

The thickness of the cathode electrode 2 is set within a range of several dozen nm to a several μm, and preferably within a range of several hundred nm to a several μm.

Details of the constitution of the electron-emitting device formed by the above manufacturing method are described below with reference to FIGS. 1A to 1C and FIGS. 3A and 3B.

The example that the step forming member 10 is constituted by laminating the first insulating layer 3 and the second insulating layer 4 is illustrated. However, the step forming member 10 can be also composed of three or more layers.

The gate electrode 5 is placed on the upper surface of the second insulating layer 4 composing the step forming member 10, and the recess portion 7 is provided on the portion as the side surface of the step forming member 10 and just below the end portion of the gate electrode 5. In this example, the recess portion 7 is provided on the side surface of the step forming member 10 so that a part of the lower surface (the surface on the substrate 1 side) of the gate electrode 5 is exposed. That is to say, the part of the lower surface of the gate electrode 5 (the exposed portion) forms the recess portion 7.

The recess portion 7, however, may be provided to a portion which is closer to the substrate 1 than an interface between the lower surface of the gate electrode 5 and the upper surface of the step forming member 10. That is to say, the recess portion 7 may be provided so as to be separated from the lower surface of the gate electrode 5 (the lower surface of the gate electrode 5 is not exposed). In any cases, in the electron-emitting device in this embodiment, the gate electrode 5 is arranged on (above) the recess portion 7.

The side surface of the first insulating layer 3 composing the step forming member 10 is composed of a tilted slope, and the side surface of the first insulating layer 3 and the surface of the substrate 1 preferably forms an angle of less than 90° from a viewpoint of the above manufacturing method. The angle formed by the side surface of the second insulating layer 4 (see FIG. 6C) and the normal line 12 of the substrate 1 is not particularly limited as long as electron emission from the protruding portion of the conductive film 6A as the cathode is not prevented.

Characteristic and preferable mode of the protruding portion of the conductive film (cathode) 6A are described below with reference to FIGS. 3A and 3B.

FIG. 3A is an enlarged diagram of FIG. 1B, and FIG. 3B is an enlarged diagram of an area surrounded by a circular dotted line of FIG. 3A (the protruding portion of the conductive film 6A).

When the tip (edge) of the protruding portion of the conductive film 6A is enlarged, a portion represented by a curvature radius r is present at the edge (see the circle surrounded by the dotted line in FIG. 3B). The strength of the electric field at the edge of the conductive film 6A varies according to the value of the curvature radius r. As the curvature radius r is smaller, electric flux lines concentrate, so that a higher electric field can be formed at the edge of the protruding portion. Therefore, when the electric field at the edge of the protruding portion is constant, namely, a driving field (the electric field at the time of electron emission) is constant, and when the curvature radius r is relatively small, a shortest distance d between the edge of the protruding portion of the conductive film 6A and the gate electrode 5 is large. When r is relatively large, the shortest distance d is small. Since the difference in the shortest distanced influences a difference in a number of scattering times, r is smaller and as d is larger, the electron emission efficiency of the electron-emitting device is higher.

The protruding portion of the conductive film 6A enters the recess portion 7 by a distance x from an interface between the side surface of the step forming member 10 and the recess portion 7 (the corner portion 32 of the first insulating layer 3) as shown in FIG. 3B.

When the conductive film 6A enters the recess portion 7 by the distance x, the following three advantages are generated.

(1) The protruding portion of the conductive film 6A to be the electron-emitting portion contacts with the first insulating layer 3 with a wide area, and a mechanical adhesion force is strengthened (rise in the adhesion strength).

(2) A thermal contact area between the protruding portion of the conductive film 6A to be the electron-emitting portion and the first insulating layer 3 is widened, and heat generated in the electron-emitting portion can be transferred to the first insulating layer 3 efficiently (reduction in thermal resistance).

(3) The protruding portion is inclined with respect to the upper surface of the first insulating layer 3, so that the strength of the electric field at triple point of the insulating layer, the vacuum and the metal interface is weakened. As a result, discharge phenomenon due to abnormal electric field can be prevented.

The distance x is a distance from the end portion of the conductive film 6A in contact with the surface of the recess portion 7 to the edge of the recess portion 7. In other words, the distance x is a length by which the upper surface of the first insulating layer 3 and the conductive film 6A contact with a depth direction of the recess portion 7.

Figure 2:
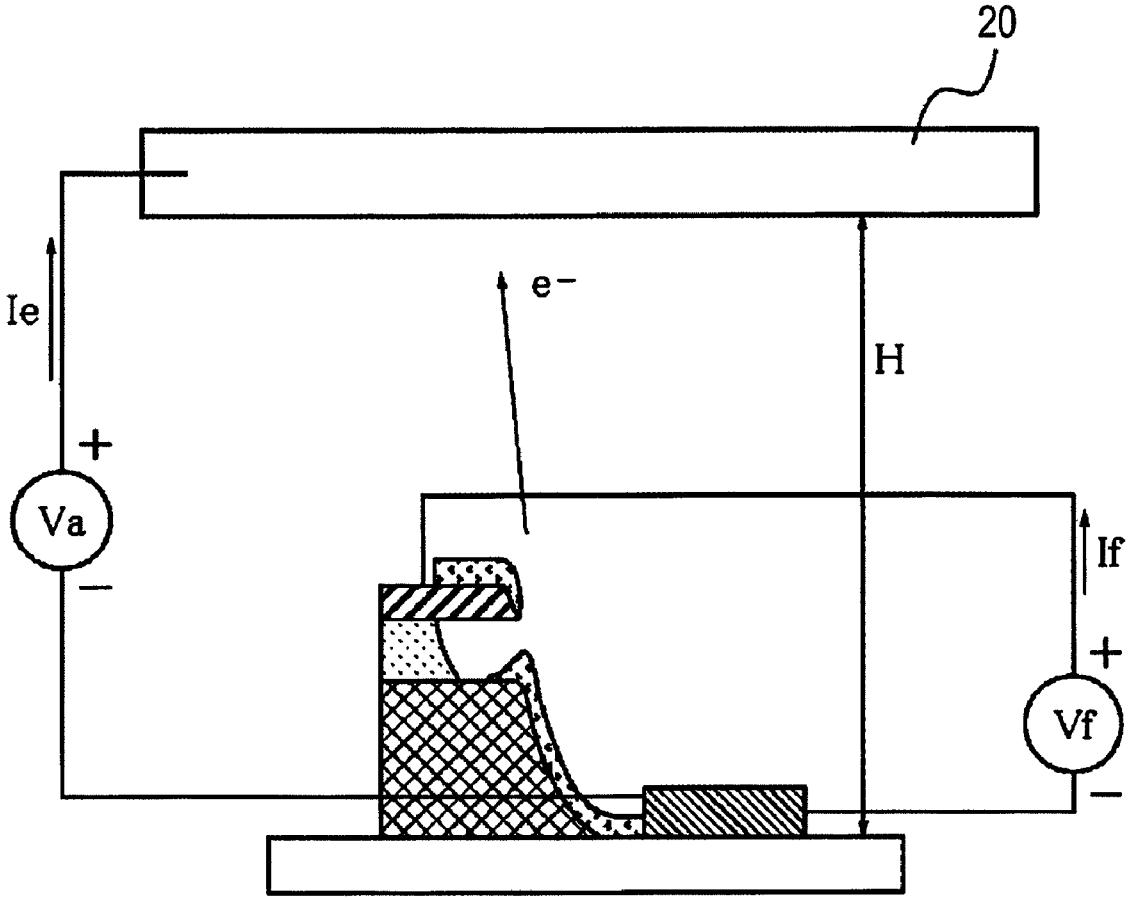
FIG. 2 is a diagram explaining a constitution for measuring an electron emission property.

A trajectory of the electrons emitted by applying a drive voltage to the electron-emitting device as shown in FIG. 2 is described below.

FIG. 2 is a diagram illustrating a relationship between a power source and an electric potential at the time of measuring the electron-emitting characteristic. "Vf" shows a voltage to be applied between the cathode and the gate, "If" shows a device current to be flowing at this time, "Va" shows a voltage to be applied between the cathode and the anode electrode 20, and "Ie" shows an electron emission current. The electron emission efficiency (η) is obtained according to the efficiency $\eta = Ie/(If+Ie)$ by using the electric current (If) detected and the electric current (Ie) taken out into vacuum at the time of applying the voltage (Vf) to the device.

(Description about Scattering in Electron Emission)

Figure 4:
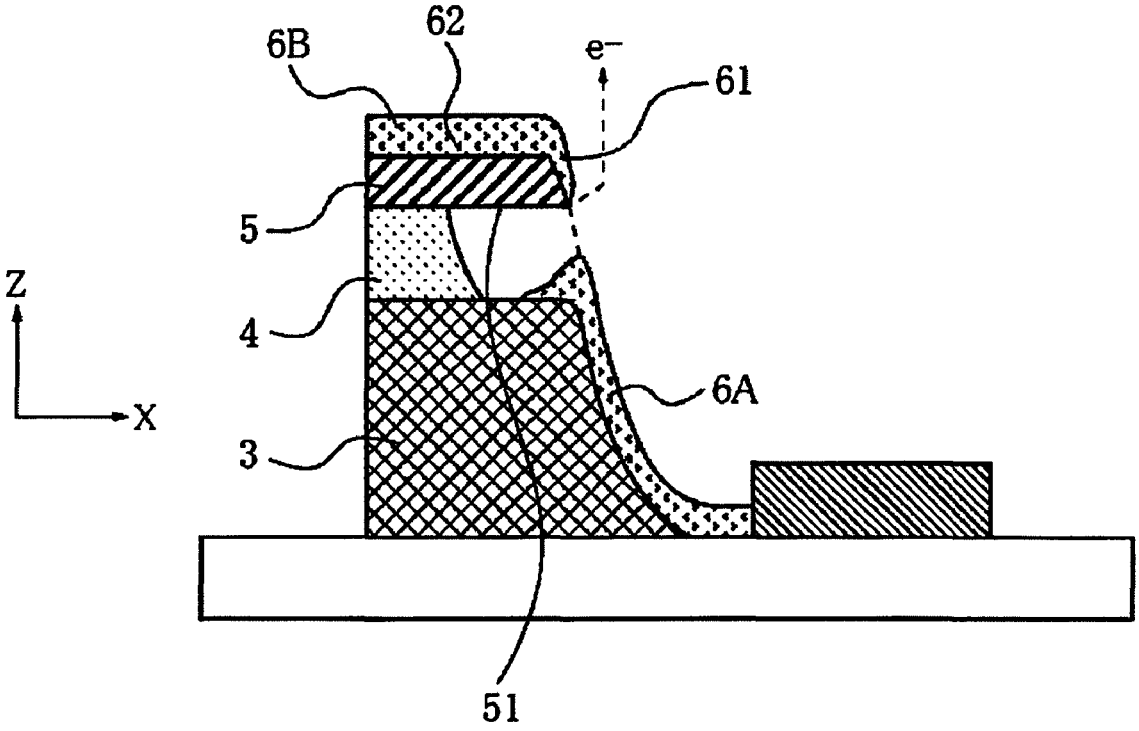
FIG. 4 is an explanatory diagram illustrating electrons emitted from the electron-emitting device.

In FIG. 4, some or all of the electrons field-emitted from the edge of the protruding portion of the conductive film 6A towards the gate electrode 5 are likely to collide with the gate electrode 5 or the conductive film 6B on the gate electrode 5.

The place where the emitted electrodes collide with the gate electrode 5 or the conductive film 6B is roughly divided into a portion 51 of the gate electrode 5 forming the recess portion 7 (the lower surface of the gate electrode 5) and a slope 61 of the conductive film 6B. In many cases, the electrons collide with the slope 61 of the conductive film 6B.

At this time, when the resistivity of the conductive film 6B is high, the conductive film 6B generates heat due to the collision of the electrons and is likely to be evaporated or deformed. In this case, "If" is deteriorated, namely, a problem relating to reliability arises. For this reason, it is satisfactory that the resistivity of the conductive film 6B is small.

FIG. 5A illustrates a relationship between the film density and the resistivity of the molybdenum film. As is clear from the drawing, in general, the film density and the resistivity of the metal are inversely proportional to each other. For this reason, the film density should be increased in order to reduce the resistivity.

The image display apparatus having an electron source obtained by arranging the plurality of electron-emitting devices is described below with reference to FIGS. 9 to 11.

Figure 9:
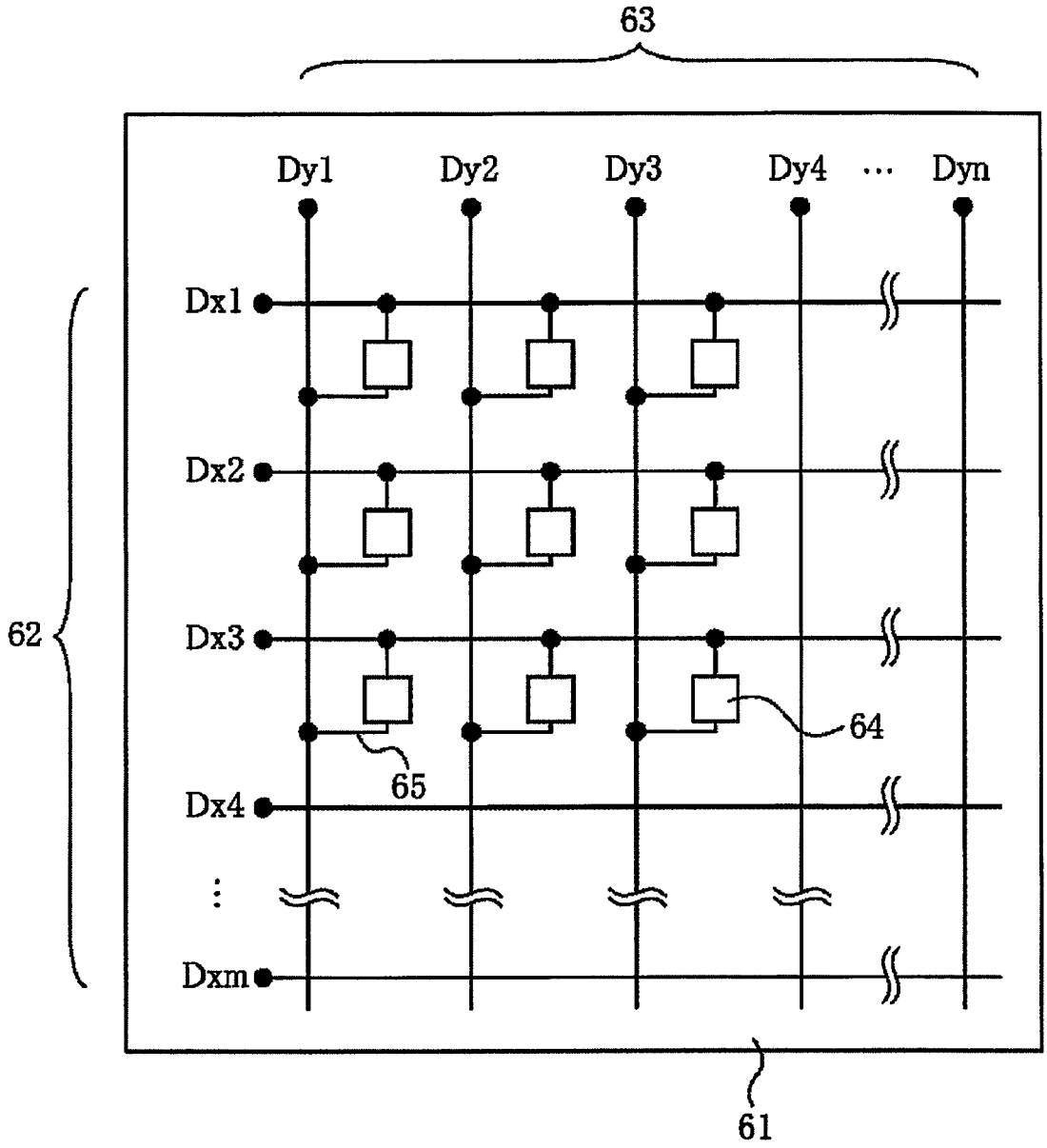
FIG. 9 is an explanatory diagram illustrating an electron source using the electron-emitting device.

In FIG. 9, reference numeral 61 is a substrate, 62 is an X-direction wiring, and 63 is a Y-direction wiring. Reference numeral 64 is the electron-emitting device, and 65 is wire connection. The X-direction wiring 62 is a wiring connected to the cathode electrodes 2 commonly, and the Y-direction wiring 63 is a wiring connected to the gate electrodes 5 commonly.

The r-numbered X-direction wirings 62 are composed of DX1, DX2, . . . DXm, and can be composed of a conductive material such as metal formed by the vacuum evaporation method, a printing method or the sputtering method. The material, a thickness and a width of the wirings are suitably designed.

The n-numbered Y-direction wirings 63 are composed of DY1, DY2, . . . DYn, and are formed similarly to the X-direction wirings 62. An interlayer insulating layer, not shown, is provided between the m-numbered X-direction wirings 62 and the n-numbered Y-direction wirings 63, and they are electrically separated (m and n are positive integers).

The interlayer insulating layer, not shown, is formed by using the vacuum evaporation method, the printing method or the sputtering method. The interlayer insulating layer is formed into a desired shape on whole or part of the surface of the substrate 61 formed with the X-direction wirings 62. The thickness, the material and the manufacturing method are suitably set as to be capable of withstanding particularly a potential difference on a cross portion between the X-direction wirings 62 and the Y-direction wirings 63. The X-direction wirings 62 and the Y-direction wirings 63 are drawn as external terminals.

As to the materials composing the wirings 62 and 63, the material composing the wire connection 65, and the materials composing the cathode and the gate, some or all of their constituent elements may be the same or different.

A scan signal application unit, not shown, which applies a scan signal for selecting a row of the electron-emitting devices 64 arranged in the X direction is connected to the X direction wirings 62. On the other hand, a modulation signal generating unit, not shown, which generates modulation signals to be supplied to the electron-emitting devices 64 on the respective rows according to an input signal is connected to the Y direction wirings 63.

The drive voltage to be applied to each electron-emitting device is supplied as a difference voltage of the scan signal and the modulation signal applied to the device.

In the above constitution, the individual devices are selected by using a simple matrix wiring so as to be capable of being driven individually.

The image display apparatus constituted by using the electron source of the simple matrix arrangement is described with reference to FIG. 10. FIG. 10 is a diagram illustrating one example of an image display panel 77 of the image display apparatus.

Figure 10:
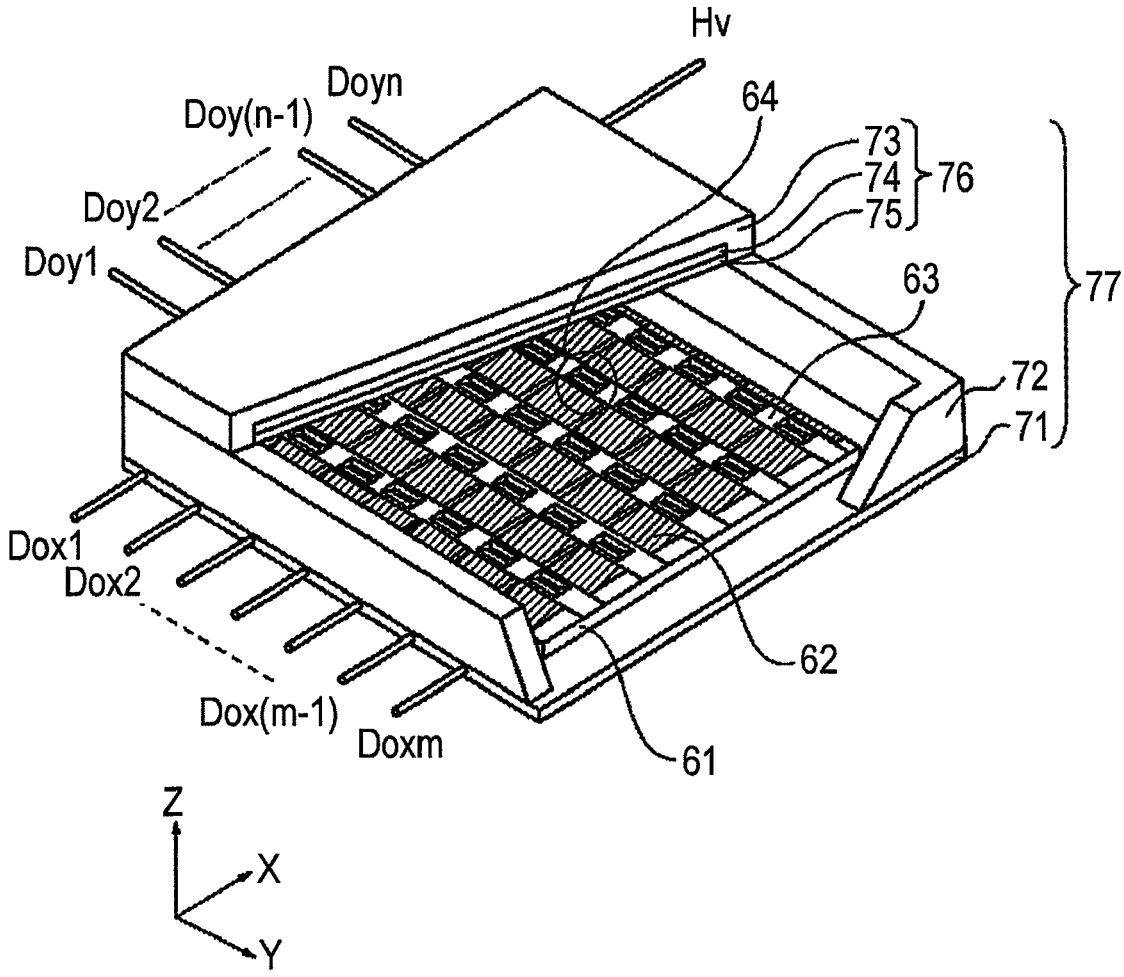
FIG. 10 is an explanatory diagram illustrating an image display apparatus using the electron-emitting device.

In FIG. 10, reference numeral 61 is a substrate where a plurality of electron-emitting devices is arranged, and 71 is a rear plate which fixes the substrate 61. Reference numeral 76 is a face plate where a metal back 75 as an anode and a fluorescent substrate film as a film 74 of a light-emitting member are formed on an inner surface of a glass substrate 73.

Reference numeral 72 is a supporting frame, and the rear plate 71 and the face plate 76 are sealed (bonded) into the supporting frame 72 by using a bonding material such as frit glass. Reference numeral 77 is an envelope, and it is formed by calcining for 10 or more minutes within a temperature range of 400 to 500° C. in air or nitrogen and sealing.

Further, reference numeral 64 corresponds to the electron-emitting device in FIG. 1A, and 62 and 63 are the X direction wirings and the Y direction wirings which are connected to the cathode electrodes 2 and the gate electrodes 5 of the electron-emitting devices, respectively. FIG. 10 schematically illustrates a positional relationship between the electron-emitting devices 64 and the wirings 62 and 63. Actually, the electron-emitting devices 64 are arranged on the substrate beside the cross portions between the wirings 62 and 63.

The image display panel 77 is composed of the face plate 76, the supporting frame 72 and the rear plate 71. Since the rear plate 71 is provided in order to mainly heighten the strength of the substrate 61, when the substrate 61 itself has sufficient strength, the rear plate 71 is unnecessary.

That is to say, the supporting frame 72 is sealed directly to the substrate 61, and the supporting frame and the face plate 76 may be sealed so as to compose the envelope 77. Further, a supporter, not shown, which is called as a spacer may be provided between the face plate 76 and the rear plate 71 to obtain the image display panel 77 having sufficient strength against atmosphere pressure.

A configuration example of the drive circuit for television display based on a television signal on the image display panel 77 is described below with reference FIG. 11.

Figure 11:
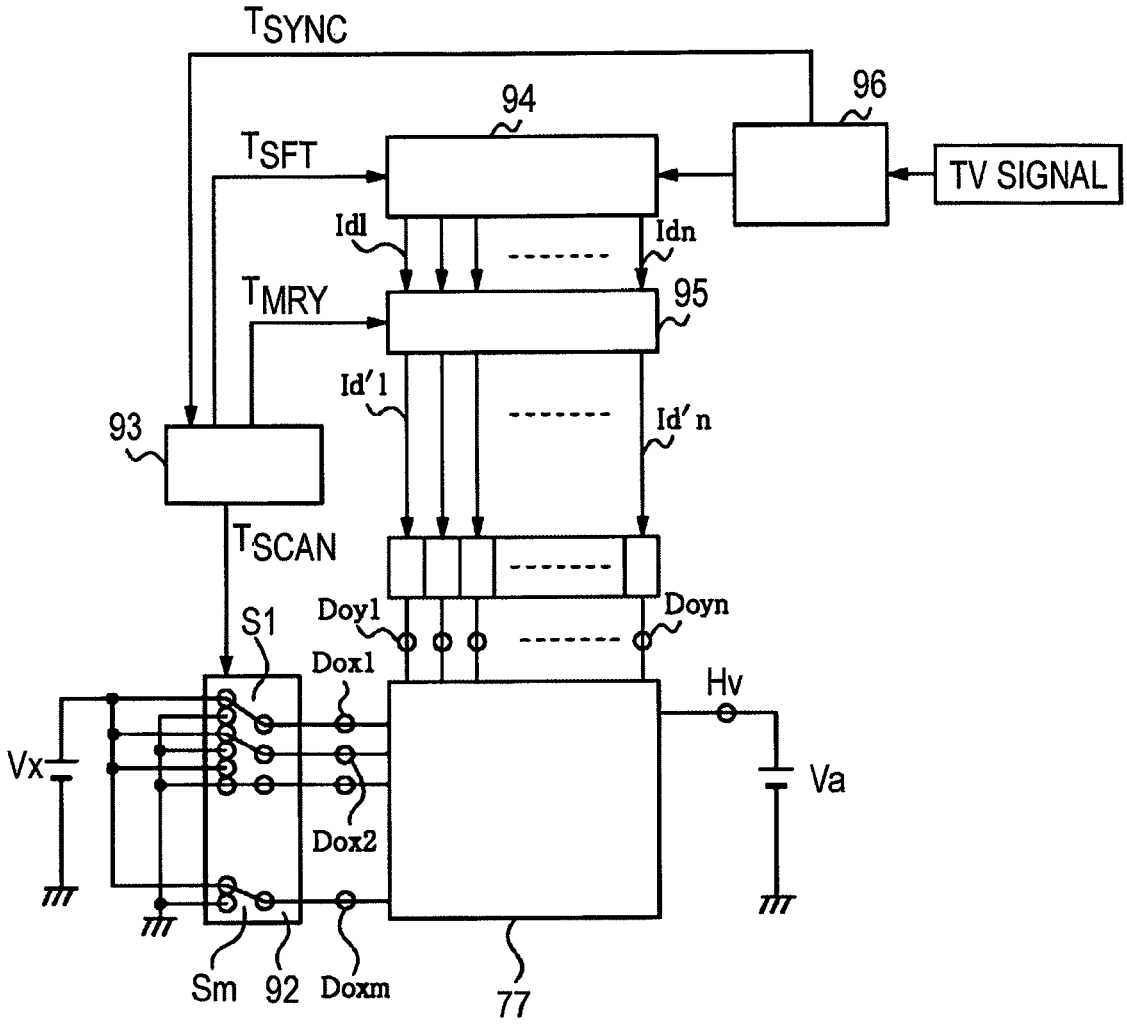
FIG. 11 is a circuit diagram illustrating one example of a driving circuit which drives the image display apparatus.

In FIG. 11, reference numeral 77 is the image display panel, 92 is a scan circuit, 93 is a control circuit, and 94 is a shift register. Reference numeral 95 is a line memory, is a synchronous signal separating circuit, 97 is a modulation signal generator, and Vx and Va are DC current voltage sources.

The display panel 77 is connected to an external electric circuit via terminals Dox1 to Doxm, terminals Doy1 to Doyn, and a high-voltage terminal Hv.

A scan signal is applied to the terminals Dox1 to Doxm. The scan signal drives the electron source provided in the display panel 77, namely, the electron-emitting devices arranged into a matrix pattern and into m rows×n columns line by line (per N devices).

On the other hand, a modulation signal for controlling the output electron beams of the respective electron-emitting devices on one row selected by the scan signal is applied to the terminals Doy1 to Doyn.

A DC voltage of 10 [kV] is supplied to the high-voltage terminal Hv by the DC voltage source Va.

The emitted electrons are accelerated by the scan signal, the modulation signal and the high-voltage application to the anode to irradiate the fluorescence substance, so that an image is displayed.

EXAMPLES

More detailed examples are described below based on the above embodiment.

Example 1

A method of manufacturing the electron-emitting device in the example 1 is described with reference to FIGS. 6A to 6F.

High-strain point low-sodium glass (PD200 made by Asahi Glass Co., Ltd.) was used as the substrate 1.

At first, the insulating layers 30 and 40 and the conductive layer 50 were laminated on the substrate as shown in FIG. 6A.

The insulating layer 30 was an insulating film made of a material with excellent workability, silicon nitride ($Si_3N_4$), and was formed by the sputtering method so as to have a thickness of 500 nm.

The insulating layer 40 was an insulating film made of a material with excellent workability, silicon oxide ($SiO_2$), and was formed by the sputtering method so as to have a thickness of 30 nm.

The conductive layer 50 was composed of a tantalum nitride (TaN) film, and was formed by the sputtering method into a thickness of 30 nm.

As shown in FIG. 6B, after a resist pattern was formed on the conductive layer 50 by the photolithography technique, the conductive layer 50, the insulating layer 40 and the insulating layer 30 were worked sequentially by using the dry etching method. The conductive layer 50 was patterned by the first etching process to become the gate electrode 5, and the insulating layer 30 was patterned so as to become the first insulating layer 3.

As processed gas, $CF_4$ type gas was used for the insulating layers 30 and 40 and the conductive layer 50. The angle of the side surface of the insulating layers 30 and 40 and the gate electrode 5 after etching was set to about 80° with respect to the surface of the substrate (horizontal surface) by RIE using the gas. Further, the angle ($\alpha$) formed by the side surface 22 of the insulating layer 30 and the surface of the substrate 1 (substrate horizontal direction 11) was 80° (see FIG. 6C).

After the resist was peeled, the insulating layer 40 was etched by using BHF (high-purity buffered hydrogen fluoride LAL 100 made by Stella Chemifa Corporation) to make the depth of the recess portion 7 about 100 nm. At this second etching process, the recess portion 7 was formed on the step forming member 10 composed of the insulating layers 3 and 4 (FIG. 6C).

As shown in FIG. 6D, molybdenum (Mo) was deposited on the slope 22 and the upper surface (the inner surface of the recess portion) 21 of the first insulating layer 3, and the gate electrode 5, so that the conductive films 60A and 60B were formed simultaneously. At this time, as shown in FIG. 6D, the conductive films 60A and 60B were deposited so as to contact with each other. In this example, the sputtering method was used as the deposition method. The angle of the substrate 1 with respect to the sputtering target was tilted at 40° from the horizontal state. For this reason, the angle $\theta$ (see FIG. 6C) was 40°.

This is because the film qualities of Mo deposited on the upper surface 21 of the insulating layer 3 and the side surface 22 of the insulating layer 3 are made to be equivalent to each other. More specifically, the angle $\theta$ formed by the incident direction A of the sputtered particles and the normal line direction 12 of the surface of the substrate 1 is set so that a relationship that $\theta=\alpha/2$ holds. As a result, the film qualities of the Mo films on the side surface 21 and the upper surface 22 become equivalent to each other (FIG. 6C). In this example, since the angle $\alpha$ was 80°, the angle $\theta$ is set to 40°. In the sputtering deposition in the example, a shielding plate was provided between the substrate and the target so that the angle formed by the incident direction of the sputtered particles and the normal line direction of the target surface was 0°±10°.

The sputtered particles (Mo) from the target entered from a direction where the angle formed by the upper surface 21 of the insulating layer 3 and the side surface 22 of the insulating layer 3 was bisected (in this example, as shown in FIG. 6C, since $\alpha$=80°, a direction where $\theta$=40°). Argon plasma was created with power of 3 kW and vacuum of 0.1 Pa, and the substrate 1 was arranged so that a distance between the substrate 1 and the Mo target was 60 or less mm (mean free path at 0.1 Pa). The Mo film was formed at the deposition speed of 10 nm/min so that the thickness of Mo on the side surface 22 of the insulating layer 3 became 60 nm.

At this time, the conductive film 60A was formed so that an entering amount of the conductive film 60A into the recess portion 7 (a distance x in FIG. 3B) became 35 nm.

Observation using TEM (transmission electron microscope) and analysis using EELS (electron energy-loss spectroscope) were carried out. The film density of Mo was calculated based on the results. As a result, the film density of the conductive film 60A was equivalent on any portions.

Figure 8A:
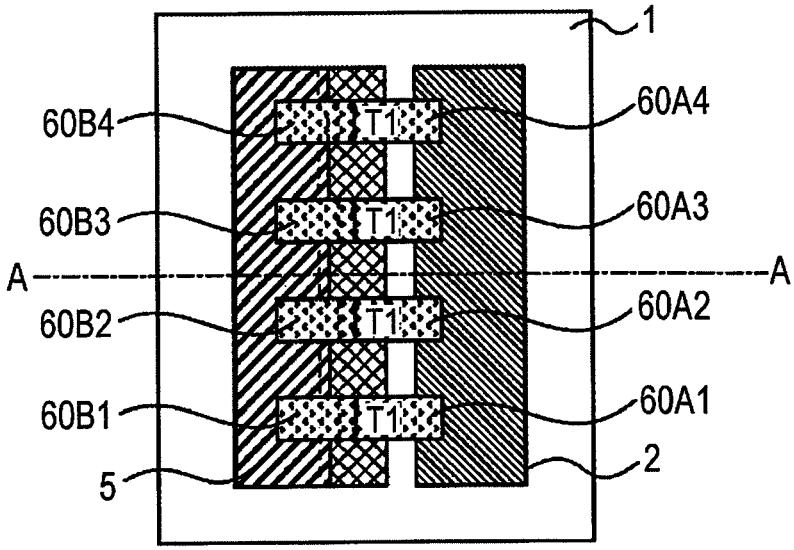
FIGS. 8A to 8C are diagrams illustrating examples of another constitution of the electron-emitting device.
Figure 8B:
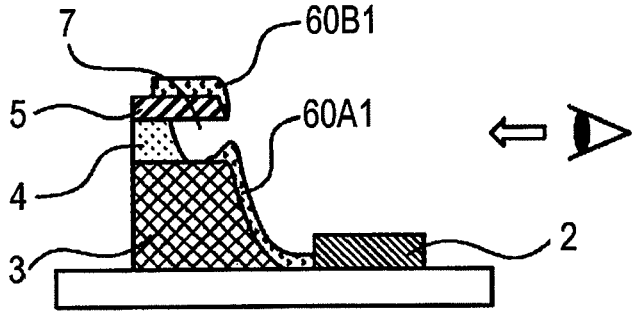
Figure 8C:
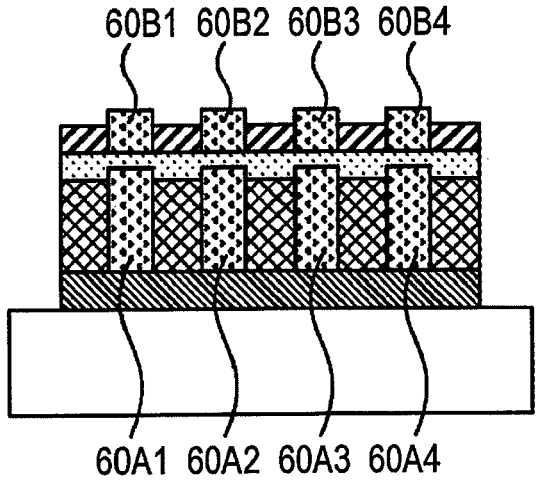

As shown in FIGS. 8A to 8C, the conductive films 60A and 60B made of Mo were subject to the patterning process for dividing them. With such a form, even when one conductive film and the gate electrode 5 are short-circuited and are broken due to discharge and the electrons are not emitted, the electron emission from another conductive film can be maintained.

A resist pattern was formed so that widths T1 of the conductive films 60A1 to 60A4 (FIG. 8A) became lines and spaces of 3 μm. Thereafter, patterning was carried out by using the dry etching method, so that the reed-shaped conductive films 60A1 to 60A4 and the reed-shaped conductive films 60B1 to 60B4 were formed. Since molybdenum is a material for creating fluoride, $CF_4$ type gas was used as the processed gas at this time.

At this stage, as shown in FIG. 6D, the conductive films 60A1 to 60A4 and the conductive films 60B1 to 60B4 contacted with each other.

As shown in FIG. 6E, the reed-shaped conductive films 60A1 to 60A4 and the reed-shaped conductive films 60B1 to 60B4 were subject to the etching process (third etching process) in order to form the gap 8 to be the electron-emitting portion.

The third etching process included a step of oxidizing the surfaces of the conductive films 60A1 to 60A4 and the conductive films 60B1 to 60B4 made of Mo, and a step of removing the oxidized surfaces.

Specifically, in the Mo oxidizing method, 350 mJ/cm$^2$ of excimer UV (wavelength 172 nm, illuminance: 18 mw/cm$^2$) was emitted in atmosphere by using an excimer UV exposing apparatus. Under this condition, an oxide layer with thickness of about 1 to 2 nm was formed on the surfaces of the conductive films 60A1 to 60A4 and the conductive films 60B1 to 60B4. That is to say, the oxide film with thickness of about 1 to 2 nm was formed on the surfaces of Mo on the upper surface 21 of the first insulating layer 3 and Mo on the side surface 22 of the first insulating layer 3. The substrate 1 was soaked into warm water (45° C.) for 5 minutes so that the molybdenum oxide layer was removed. At this step, the gap 8 was formed between the conductive films 60A1 to 60A4 and the conductive films 60B1 to 60B4 (FIG. 6E). At this step, the protruding portions of the conductive films 60A1 to 60A4 were pointed.

As a result of the analysis using the cross-section TEM, the shortest distances 8 between the protruding portions of the conductive films 60A1 to 60A4 to be the electron-emitting portions and the gate electrode 5 in FIG. 6E were averagely 15 nm.

As shown in FIG. 6F, the cathode electrode 2 was formed so that the electron-emitting device was formed. Copper (Cu) was used for the electrode 2. The electrode 2 was formed by the sputtering method, and its thickness was 500 nm.

In the electron-emitting device manufactured in this example, the etching rates of Mo on the upper surface 21 of the insulating layer 3 and Mo on the side surface 22 of the first insulating layer 3 were equivalent to each other. For this reason, even when the third etching process was executed, preference etching of Mo on the side surface 22 was repressed. As a result, the electron-emitting device was obtained in which high electron emission efficiency of about 11% was obtained, and the electric potential was supplied stably to the protruding portion of the conductive film 6A from the cathode electrode, so that stable electron mission was obtained.

In the image display apparatus using a lot of electron-emitting devices manufactured in this example, formability of an electron beam was excellent, and a satisfactory image without defective pixel was maintained for a long period after occurrence of discharge. Further, the image display apparatus of low power consumption was achieved due to improvement of the electron emission efficiency.

Example 2

In this example, the etching rate of Mo on the side surface of the insulating layer 3 was reduced further than that in the example 1.

Since the basic method of manufacturing the electron-emitting device in this example is similar to that in the example 1, only a difference from the example 1 is described.

The same steps as example 1 were executed until forming the recess portion 7 on the step forming member 10 composed of the insulating layers 3 and 4 by etching the insulating layer 40.

In this example, the angle of the substrate 1 with respect to the sputtering target was tilt at 50° with respect to the horizontal state. The angle θ (see FIG. 6C) was 50°.

This is because the film quality of Mo to be deposited on the side surface 22 of the insulating layer 3 is made to be better. The angle θ formed by the incident direction A of the sputtered particles and the normal line direction 12 of the surface of the substrate 1 is set within a range of $\alpha/2 \leqq \theta \leqq 90°$. As a result, the film quality of Mo on the side surface can be made to be better. Therefore, in this example, since the angle α formed by the side surface 22 of the insulating layer and the surface of the substrate 1 was 80°, the angle θ was set to 50°.

The other steps were the same as those in the example 1.

The conductive film 6A deposited at θ of 50° in this example was compared to a comparative conductive film 6A deposited at θ of 0°. The etching rate was reduced by about 40% in the case of the deposition at θ of 50°. The etching rate of Mo on the side surface 22 of the insulating layer 3 was reduced further than that in the example 1.

By deposition in the range of $\alpha/2 \leqq \theta \leqq 90°$, the etching of Mo on the side surface 22 of the insulating layer 3 at an excessive rate was repressed in comparison with Mo on the upper surface 21 of the insulating layer 3.

As a result of the analysis using the cross-section TEM, the shortest distances 8 between the protruding portions of the conductive films 60A1 to 60A4 to be the electron-emitting portions and the gate electrode 5 in FIG. 6E were averagely 16 nm.

The electron-emitting device manufactured in this example had satisfactory characteristics similarly to the example 1. Further, the satisfactory image display apparatus using the electron-emitting device of this example was provided similarly to the example 1.

Example 3

In this example, Mo on the side surface of the gate electrode 5 was retreated further than the examples 1 and 2.

Since the basic method of manufacturing the electron-emitting device in this example is the same as that in the example 1, only a difference from the example 1 is described.

In this example, the conductive layer 50, the insulating layer 40 and the insulating layer 30 were etched so that the angle Φ formed by the side surface 52 of the gate electrode 5 and the horizontal direction 11 of the substrate 1 was 50°. The angle α was 80° as that in the example 1.

In this example, Mo was deposited in the state that the angle θ formed by the incident direction A of the sputtered particles and the normal line direction 12 of the substrate 1 was 70°. This is because the etching rate of Mo on the side surface 52 of the gate electrode 5 is made to be higher than the etching rate of Mo on the side surface 22 of the insulating layer 3. Since the angle Φ of the side surface 52 of the gate electrode 5 was 50° and α was 80°, $(80°+50°)/2 \leqq \theta \leqq 90°$, and thus the relational expression 1 was satisfied. As a result, the etching rate of Mo on the side surface 52 of the gate electrode 5 was higher than the etching rate of Mo on the side surface 22 of the insulating layer 3.

The steps other than the above ones were the same as those in the example 1, and the electron-emitting device of this example was manufactured.

Thereafter, the characteristics of the electron-emitting device having the constitution shown in FIG. 2 were evaluated.

In the evaluation of the characteristics, the electric potential of the gate electrode 5 (and the conductive films 60B1 to 60B4) was set to 30V, and the electric potential of the conductive films 60A1 to 60A4 was defined as 0V via the electrode 2. As a result, a drive voltage of 30V was applied between the gate electrode 5 and the conductive films 60A1 to 60A4. As a result, the obtained electron-emitting device had an average electron-emitting current Ie of 15 μA, and the high electron emission efficiency of averagely 12%. A leak current due to the contact in a minute area between the conductive films 60A1 to 60A4 and the gate electrode 5 (conductive films 60B1 and 60B4) was not observed.

In this example, since Mo on the side surface of the gate electrode 5 was retreated further than the electron emitting device in the examples 1 and 2, collision and scattering of the electrons field-emitted from the edges of the conductive films 60A1 to 60A4 with the Mo film on the side surface of the gate electrode 5 was reduced. As a result, more electrons could reach the anode electrode, and the electron emission efficiency was improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-324464, filed on Dec. 19, 2008, which is hereby incorporated by reference here in its entirety.

What is claimed is:

1. An electron-emitting device manufacturing method comprising:

a first step of forming a conductive film on an insulating layer having an upper surface and a side surface connected to the upper surface via a corner portion so as to extend from the side surface to the upper surface and cover at least a part of the corner portion; and a second step of etching the conductive film in a film thickness direction, wherein at the first step, the conductive film is formed so that film density of a portion of the conductive film on the side surface of the insulating layer becomes equivalent to film density of a portion of the conductive film on the upper surface of the insulating layer.

2. An electron-emitting device manufacturing method according to claim 1, wherein the second step includes a process for oxidizing a surface of the conductive film before the process of etching the conductive film.

3. An electron-emitting device manufacturing method according to claim 2, wherein at the second step, the process for oxidizing the surface of the conductive film and the process for etching the conductive film are repeated.

4. An electron-emitting device manufacturing method according to claim 1, further comprising:

a step of providing a gate electrode on the insulating layer via a second insulating layer different from the insulating layer, wherein at the first step, in addition to the conductive film on the insulating layer, another second conductive film which is connected to the conductive film on the insulating layer is formed on the gate electrode.

5. An electron-emitting device manufacturing method according to claim 4, wherein an angle formed by a side surface of the gate electrode and a normal line of the upper surface of the insulating layer is larger than an angle formed by the side surface of the insulating layer and the normal line of the upper surface of the insulating layer, at the first step, the conductive film on the insulating layer and the second conductive film on the gate electrode are formed simultaneously.

6. An electron-emitting device manufacturing method comprising:

a first step of forming a conductive film on an insulating layer having an upper surface and a side surface connected to the upper surface so as to extend from the side surface to the upper surface; and a second step of etching the conductive film in a film thickness direction, wherein at the first step, the conductive film is formed by using a film forming method having directional characteristic such that an angle formed by an incident direction of a material of the conductive film and the side surface of the insulating layer becomes the same as or larger than an angle formed by the incident direction of the material of the conductive film and the upper surface of the insulating layer.

7. An electron-emitting device manufacturing method according to claim 6, wherein the insulating layer is provided on a surface of a substrate so that an angle of the side surface of the insulating layer and the surface of the substrate becomes α, an angle θ formed by the incident direction of the material of the conductive film and a normal line of the surface of the substrate is not less than α/2 and not more than 90°.

8. An electron-emitting device manufacturing method comprising:

a first step of forming a conductive film on an insulating layer having an upper surface and a side surface connected to the upper surface so as to extend from the side surface to the upper surface; and a second step of etching the conductive film in a film thickness direction, wherein at the first step, the conductive film is formed so that film density of a portion of the conductive film on the side surface of the insulating layer becomes equivalent to or higher than film density of a portion of the conductive film on the upper surface of the insulating layer.

9. An electron-emitting device manufacturing method according to claim 8, wherein at the first step, the conductive film is formed by using a film forming method having directional characteristic such that an angle formed by an incident direction of a material of the conductive film and the side surface of the insulating layer becomes the same as or larger than an angle formed by the incident direction of the material of the conductive film and the upper surface of the insulating layer, the insulating layer is provided on a surface of a substrate so that an angle formed by the side surface of the insulating layer and the surface of the substrate becomes $\alpha$, an angle $\theta$ formed by the incident direction of the material of the conductive film and a normal line of the surface of the substrate is not less than $\alpha/2$ and not more than 90°.

10. A method of manufacturing an image display apparatus having a plurality of electron-emitting devices and a light-emitting member which is irradiated with electrons emitted from the plurality of electron-emitting devices, wherein each of the plurality of electron-emitting devices is manufactured by the manufacturing method according to claim 1.

11. A method of manufacturing an image display apparatus having a plurality of electron-emitting devices and a light-emitting member which is irradiated with electrons emitted from the plurality of electron-emitting devices, wherein each of the plurality of electron-emitting devices is manufactured by the manufacturing method according to claim 6.

12. A method of manufacturing an image display apparatus having a plurality of electron-emitting devices and a light-emitting member which is irradiated with electrons emitted from the plurality of electron-emitting devices, wherein each of the plurality of electron-emitting devices is manufactured by the manufacturing method according to claim 8.

* * * * *